US011676535B2

(12) United States Patent
Jeon et al.

(10) Patent No.: US 11,676,535 B2
(45) Date of Patent: Jun. 13, 2023

(54) PIXEL AND DISPLAY DEVICE

(71) Applicant: Samsung Display Co., Ltd., Yongin-si (KR)

(72) Inventors: Jae-Hyeon Jeon, Seoul (KR); Donggyu Lee, Yongin-si (KR); Jin-Wook Yang, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/586,054

(22) Filed: Jan. 27, 2022

(65) Prior Publication Data

US 2022/0415254 A1 Dec. 29, 2022

(30) Foreign Application Priority Data

Jun. 25, 2021 (KR) ..... 10-2021-0082820

(51) Int. Cl.
*G09G 3/3233* (2016.01)

(52) U.S. Cl.
CPC ... *G09G 3/3233* (2013.01); *G09G 2300/0426* (2013.01); *G09G 2310/0278* (2013.01); *G09G 2320/0233* (2013.01)

(58) Field of Classification Search
CPC ..... G09G 3/3233; G09G 2300/0426; G09G 2310/0278; G09G 2320/0233
See application file for complete search history.

(56) References Cited

U.S. PATENT DOCUMENTS

| | | | | |
|---|---|---|---|---|
| 11,094,259 | B2 | 8/2021 | Kim et al. | |
| 2009/0027312 | A1* | 1/2009 | Han | G09G 3/3233 345/76 |
| 2012/0013597 | A1* | 1/2012 | Han | G09G 3/3233 345/212 |
| 2016/0055792 | A1* | 2/2016 | Lee | G09G 3/3233 315/173 |
| 2019/0347987 | A1* | 11/2019 | Zhao | G09G 3/3233 |
| 2020/0082768 | A1* | 3/2020 | Oh | G09G 3/3291 |
| 2021/0049965 | A1 | 2/2021 | Jeon et al. | |

FOREIGN PATENT DOCUMENTS

| | | | |
|---|---|---|---|
| KR | 1020190133817 | A | 12/2019 |
| KR | 1020210019635 | A | 2/2021 |

* cited by examiner

*Primary Examiner* — Jeff Piziali
(74) *Attorney, Agent, or Firm* — Cantor Colburn LLP

(57) ABSTRACT

A pixel of a display device includes a light-emitting diode and a pixel circuit that provides a current corresponding to a data signal to the light-emitting diode in response to a plurality of scan signals and a light emission control signal. The light emission control signal includes a first section and a second section, the second section includes a light-emission-on section and a light-emission-off section, the light emission control signal has an active level in the light-emission-on section and has an inactive level in each of the first section and the light-emission-off section, and the light-emission-on section and the light-emission-off section of the light emission control signal may vary depending on a light emission ratio of a dimming mode.

18 Claims, 15 Drawing Sheets

PIXEL AND DISPLAY DEVICE

This application claims priority to Korean Patent Application No. 10-2021-0082820, filed on Jun. 25, 2021, and all the benefits accruing therefrom under 35 U.S.C. § 119, the content of which in its entirety is herein incorporated by reference.

BACKGROUND

1. Field

Embodiments of the invention described herein relate to a pixel and a display device including the same.

2. Description of the Related Art

Among display devices, an organic light-emitting display device displays an image by an organic light-emitting diode that emits light by recombination of electrons and holes. The organic light-emitting display device has a fast response speed and is driven with low power consumption.

The organic light-emitting display device includes pixels connected to data lines and scan lines. The pixels generally include the organic light-emitting diode and a circuit unit for controlling an amount of current flowing to the organic light-emitting diode. The organic light-emitting diode generates light having a predetermined luminance in response to the amount of current transferred from the circuit unit.

SUMMARY

Embodiments of the invention provide a pixel capable of operating at various driving frequencies and a display device including the pixel.

In an embodiment of the invention, a pixel includes a light-emitting diode and a pixel circuit that provides a current corresponding to a data signal to the light-emitting diode in response to a plurality of scan signals and a light emission control signal. The light emission control signal includes a first section and a second section, the second section includes a light-emission-on section and a light-emission-off section subsequent to the light-emission-on section, the light emission control signal has an active level in the light-emission-on section and has an inactive level in each of the first section and the light-emission-off section, and the light-emission-on section and the light-emission-off of the light emission control signal vary depending on a light emission ratio of a dimming mode.

In an embodiment, a maintaining time of the first section of the light emission control signal may be uniformly maintained during the dimming mode.

In an embodiment, as the light emission ratio of the dimming mode increases, the light-emission-on section of the second section may decrease and the light-emission-off section of the second section may increase.

In an embodiment, the first section may be a time section until the light emission control signal transitions from the inactive level to the active level, after any one of the plurality of scan signals transitions from the active level to the inactive level.

In an embodiment, the pixel circuit may include a first capacitor connected between a first node and a second node, a first transistor including a first electrode electrically connected to a first voltage line, a second electrode electrically connected to a first electrode of the light-emitting diode, and a gate electrode connected to the second node, a second transistor including a first electrode which receives the data signal, a second electrode connected to the first node, and a gate electrode which receives a first scan signal among the plurality of scan signals, and a third transistor including a first electrode connected to the second electrode of the first transistor, a second electrode connected to the second node, and a gate electrode which receives a second scan signal among the plurality of scan signals.

In an embodiment, the light emission control signal may include a first light emission control signal and a second light emission control signal.

In an embodiment, the pixel circuit may include a light emission control transistor including a first electrode connected to the first voltage line, a second electrode connected to the first electrode of the first transistor, and a gate electrode which receives the first light emission control signal, and a bias transistor including a first electrode connected to the first electrode of the first transistor, a second electrode which receives a bias voltage, and a gate electrode which receives a fourth scan signal among the plurality of scan signals.

In an embodiment, the light-emitting diode may further includes a second electrode, the first voltage line may receive a first driving voltage, and the second electrode of the light-emitting diode may be connected to a second voltage line which receives a second driving voltage different from the first driving voltage.

In an embodiment, the pixel circuit may further include a fourth transistor including a first electrode connected to the first node, a second electrode connected to a third voltage line, and a gate electrode which receives the second scan signal, a fifth transistor including a first electrode connected to the second node, a second electrode connected to a fourth voltage line, and a gate electrode which receives a third scan signal among the plurality of scan signals, a sixth transistor including a first electrode connected to the second electrode of the first transistor, a second electrode connected to the first electrode of the light-emitting diode, and a gate electrode which receives the second light emission control signal, a seventh transistor including a first electrode connected to the first electrode of the light-emitting diode, a second electrode connected to the fourth voltage line, and a gate electrode which receives the fourth scan signal among the plurality of scan signals, and a second capacitor connected between the first voltage line and the first node.

In an embodiment, the third voltage line may receive a reference voltage, and the fourth voltage line may receive an initialization voltage.

In an embodiment, each of the first light emission control signal and the second light emission control signal may include the first section and the second section, and the second section may include the light-emission-on section and the light-emission-off section.

In an embodiment, an active section in which the pixel circuit receives the data signal and a blank section in which the pixel circuit does not receive the data signal may form one frame, and each of the active section and the blank section may include the first section and the second section.

In an embodiment of the invention, a display device includes a display panel including a pixel connected to a plurality of scan lines, a light emission control line, and a data line, a scan driving circuit that outputs a plurality of scan signals to the plurality of scan lines, a data driving circuit that outputs a data signal to the data line, a light emission driving circuit that outputs a light emission control signal to the light emission control line, and driving controller that controls the scan driving circuit, the data driving circuit, and the light emission driving circuit. The pixel includes a light-emitting diode and a pixel circuit that provides a current corresponding to the data signal to the light-emitting diode in response to the plurality of scan signals and the light emission control signal, and the light emission control signal includes a first section and a second section, the second section includes a light-emission-on section and a light-emission-off section, the light emission control signal has an active level in the light-emission-on section and has an inactive level in each of the first section and the light-emission-off section, and the light-emission-on section and the light-emission-off section of the light emission control signal vary depending on a light emission ratio of a dimming mode.

In an embodiment, a maintaining time of the first section of the light emission control signal may be uniformly maintained during the dimming mode.

In an embodiment, as the light emission ratio of the dimming mode increases, the light-emission-on section of the second section may decrease and the light-emission-off section of the second section may increase.

In an embodiment, the first section may be a time section until the light emission control signal transitions from the inactive level to the active level, after any one of the plurality of scan signals transitions from the active level to the inactive level.

In an embodiment, the pixel circuit may include a first capacitor connected between a first node and a second node, a first transistor including a first electrode electrically connected to a first voltage line, a second electrode electrically connected to a first electrode of the light-emitting diode, and a gate electrode connected to the second node, a second transistor including a first electrode connected to the data line, a second electrode connected to the first node, and a gate electrode which receives a first scan signal among the plurality of scan signals, and a third transistor including a first electrode connected to the second electrode of the first transistor, a second electrode connected to the second node, and a gate electrode which receives a second scan signal among the plurality of scan signals.

In an embodiment, the pixel circuit may include a fourth transistor including a first electrode connected to the first node, a second electrode connected to a third voltage line, and a gate electrode which receives the second scan signal, a fifth transistor including a first electrode connected to the second node, a second electrode connected to a fourth voltage line, and a gate electrode which receives a third scan signal among the plurality of scan signals, a sixth transistor including a first electrode connected to the second electrode of the first transistor, a second electrode connected to the first electrode of the light-emitting diode, and a gate electrode which receives a second light emission control signal, a seventh transistor including a first electrode connected to the first electrode of the light-emitting diode, a second electrode connected to the fourth voltage line, and a gate electrode which receives the fourth scan signal among the plurality of scan signals, an eighth transistor including a first electrode connected to the first electrode of the first transistor, a second electrode which receives a bias voltage, and a gate electrode which receives the fourth scan signal among the plurality of scan signals, a ninth transistor including a first electrode connected to the first voltage line, a second electrode connected to the first electrode of the first transistor, and a gate electrode which receives a first light emission control signal, and a second capacitor connected between the first voltage line and the first node, and the light emission control signal includes the first light emission control signal and the second light emission control signal.

In an embodiment of the invention, a display device includes a light-emitting diode, a first capacitor connected between a first node and a second node, a first transistor including a first electrode electrically connected to a first voltage line, a second electrode electrically connected to a first electrode of the light-emitting diode, and a gate electrode connected to the second node, a second transistor including a first electrode connected to a data line, a second electrode connected to the first node, and a gate electrode which receives a first scan signal, a third transistor including a first electrode connected to the second electrode of the first transistor, a second electrode connected to the second node, and a gate electrode which receives a second scan signal, a light emission control transistor including a first electrode connected to the first voltage line, a second electrode connected to the first electrode of the first transistor, and a gate electrode which receives a first light emission control signal, and a bias transistor including a first electrode connected to the first electrode of the first transistor, a second electrode which receives a bias voltage, and a gate electrode which receives a third scan signal. The first light emission control signal includes a first section and a second section, the second section includes a light-emission-on section and a light-emission-off section, the first light emission control signal has an active level in the light-emission-on section and has an inactive level in each of the first section and the light-emission-off section, and the light-emission-on section and the light-emission-off section of the first light emission control signal vary depending on a light emission ratio of a dimming mode.

In an embodiment, the display device may further include a fourth transistor including a first electrode connected to the first node, a second electrode connected to a reference voltage line, and a gate electrode which receives the third scan signal, a fifth transistor including a first electrode connected to the second node, a second electrode connected to an initialization voltage line, and a gate electrode which receives a fourth scan signal, a sixth transistor including a first electrode connected to the second electrode of the first transistor, a second electrode connected to the first electrode of the light-emitting diode, and a gate electrode which receives a second light emission control signal, and a seventh transistor including a first electrode connected to the first electrode of the light-emitting diode, a second electrode connected to the initialization voltage line, and a gate electrode which receives the third scan signal.

BRIEF DESCRIPTION OF THE DRAWINGS

The above and other features of the invention will become apparent by describing in detail embodiments thereof with reference to the accompanying drawings.

DETAILED DESCRIPTION

Figure 1:
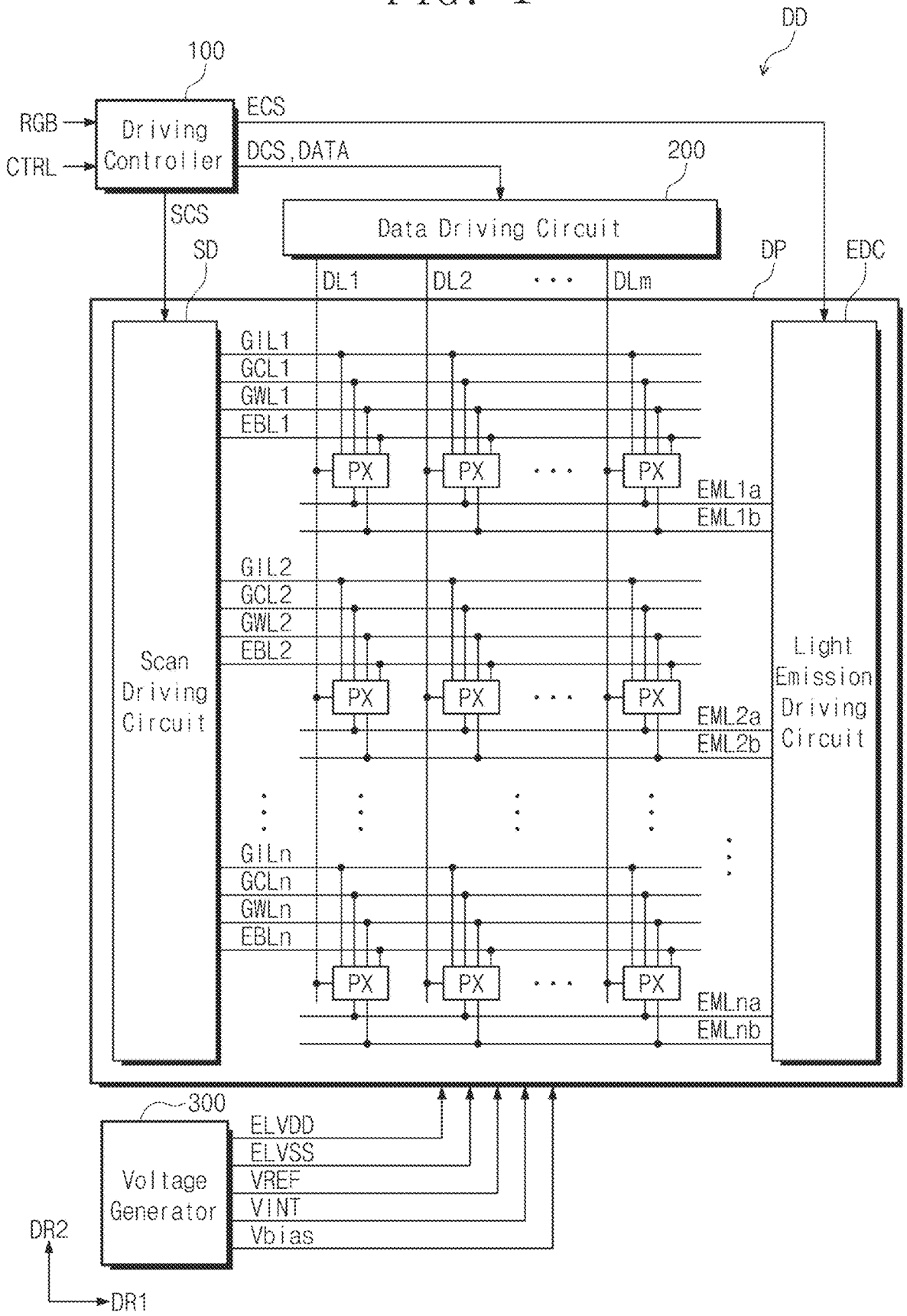
FIG. 1 is a block diagram of an embodiment of a display device according to the invention.

In the specification, when one component (or area, layer, part, or the like) is referred to as being "on", "connected to", or "coupled to" another component, it should be understood that the former may be directly on, connected to, or coupled to the latter, and also may be on, connected to, or coupled to the latter via a third intervening component.

Like reference numerals refer to like components. Also, in drawings, the thickness, ratio, and dimension of components are exaggerated for effectiveness of description of technical contents. The terminology used herein is for the purpose of describing particular embodiments only and is not intended to be limiting. As used herein, the singular forms "a", "an" and "the" are intended to include the plural forms, including "at least one," unless the content clearly indicates otherwise. "At least one" is not to be construed as limiting "a" or "an". The term "and/or" includes one or more combinations of the associated listed items.

The terms "first", "second", etc. are used to describe various components, but the components are not limited by the terms. The terms are used only to differentiate one component from another component. For example, a first component may be named as a second component, and vice versa, without departing from the spirit or scope of the invention. A singular form, unless otherwise stated, includes a plural form.

Also, the terms "under", "beneath", "on", "above" are used to describe a relationship between components illustrated in a drawing. The terms are relative and are described with reference to a direction indicated in the drawing.

It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Unless defined otherwise, all terms (including technical and scientific terms) used herein have the same meaning as commonly understood by one of ordinary skill in the art to which this disclosure belongs. In addition, terms such as terms defined in commonly used dictionaries should be interpreted as having a meaning consistent with the meaning in the context of the related technology, and should not be interpreted as an ideal or excessively formal meaning unless explicitly defined in the present disclosure.

Hereinafter, embodiments of the invention will be described with reference to accompanying drawings.

FIG. 1 is a block diagram of an embodiment of a display device according to the invention.

Referring to FIG. 1, a display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting a data format of the image signal RGB to meet a specification of an interface with the data driving circuit 200. The driving controller 100 outputs a scan control signal SCS, a data control signal DCS, and a light emission driving control signal ECS.

The data driving circuit 200 receives the data control signal DCS and the image data signal DATA from the driving controller 100. The data driving circuit 200 converts the image data signal DATA into data signals, and outputs the data signals to a plurality of data lines DL1 to DLm (m is a natural number), which will be described later. The data signals are analog voltages corresponding to gray scale values of the image data signal DATA.

The voltage generator 300 generates voltages necessary for an operation of the display panel DP. In an embodiment, the voltage generator 300 generates a first driving voltage ELVDD, a second driving voltage ELVSS, a reference voltage VREF, an initialization voltage VINT, and a bias voltage Vbias.

The display panel DP includes scan lines GIL1 to GILn, GCL1 to GCLn, GWL1 to GWLn, and EBL1 to EBLn, light emission control lines EML1*a* to EMLna and EML1*b* to EMLnb (where n is a natural number), and data lines DL1 to DLm, and pixels PX. The display panel DP may further include a scan driving circuit SD and a light emission driving circuit EDC. In an embodiment, the scan driving circuit SD is arranged on a first side (e.g., left side in FIG. 1) of the display panel DP. The scan lines GIL1 to GILn, GCL1 to GCLn, GWL1 to GWLn, and EBL1 to EBLn extend in a first direction DR1 from the scan driving circuit SD.

The light emission driving circuit EDC is arranged in a second side (e.g., right side in FIG. 1) of the display panel DP. The light emission control lines EML1*a* to EMLna and EML1*b* to EMLnb extend in a direction opposite to the first direction DR1 from the light emission driving circuit EDC.

The scan lines GIL1 to GILn, GCL1 to GCLn, GWL1 to GWLn, and EBL1 to EBLn and the light emission control lines EML1*a* to EMLna and EML1*b* to EMLnb are arranged to be spaced apart from one another in a second direction DR2 crossing the first direction DR1. The data lines DL1 to DLm extend in a direction opposite to the second direction DR2 from the data driving circuit 200 and are arranged to be spaced apart from one another in the first direction DR1.

In an example illustrated in FIG. 1, the scan driving circuit SD and the light emission driving circuit EDC are arranged facing each other with the pixels PX interposed therebetween, but the invention is not limited thereto. In an embodiment, the scan driving circuit SD and the light emission driving circuit EDC may be disposed adjacent to each other on one of the first side and the second side of the display panel DP, for example. In an embodiment, the scan driving circuit SD and the light emission driving circuit EDC may be configured as one circuit.

The plurality of pixels PX is electrically connected to the scan lines GIL1 to GILn, GCL1 to GCLn, GWL1 to GWLn, and EBL1 to EBLn, light emission control lines EML1*a* to EMLna and EML1*b* to EMLnb, and data lines DL1 to DLm, respectively. Each of the plurality of pixels PX may be electrically connected to four scan lines and two light emission control lines. In an embodiment, as illustrated in FIG. 1, the pixels PX in a first row may be connected to the scan lines GIL', GCL1, GWL1 and EBL1, and the light emission control lines EML1*a* and EML1*b*. In addition, the pixels PX in a second row may be connected to the scan lines GIL2, GCL2, GWL2 and EBL2, and the light emission control lines EML2*a* and EML2*b*, for example.

Each of the plurality of pixels PX may include a light-emitting diode ED (refer to FIG. 2) and a pixel circuit PXC (refer to FIG. 2) that controls light emission of the light-emitting diode ED. The pixel circuit PXC may include one or more transistors and one or more capacitors. The scan driving circuit SD and the light emission driving circuit EDC may include transistors formed or provided through the same process as transistors of the pixel circuit PXC.

Each of the plurality of pixels PX receives the first driving voltage ELVDD, the second driving voltage ELVSS, the reference voltage VREF, the initialization voltage VINT, and the bias voltage Vbias from the voltage generator 300.

The scan driving circuit SD receives the scan control signal SCS from the driving controller 100. The scan driving circuit SD may output scan signals to the scan lines GIL1 to GILn, GCL1 to GCLn, GWL1 to GWLn, and EBL1 to EBLn in response to the scan control signal SCS.

The light emission driving circuit EDC may output light emission control signals to the light emission control lines EML1*a* to EMLna and EML1*b* to EMLnb in response to the light emission driving control signal ECS from the driving controller 100.

The driving controller 100 in an embodiment of the invention may determine a driving frequency and may control the data driving circuit 200, the scan driving circuit SD, and the light emission driving circuit EDC, based on the determined driving frequency.

In addition, the driving controller 100 in an embodiment of the invention may provide the light emission driving control signal ECS corresponding to the dimming mode to the light emission driving circuit EDC.

Figure 2:
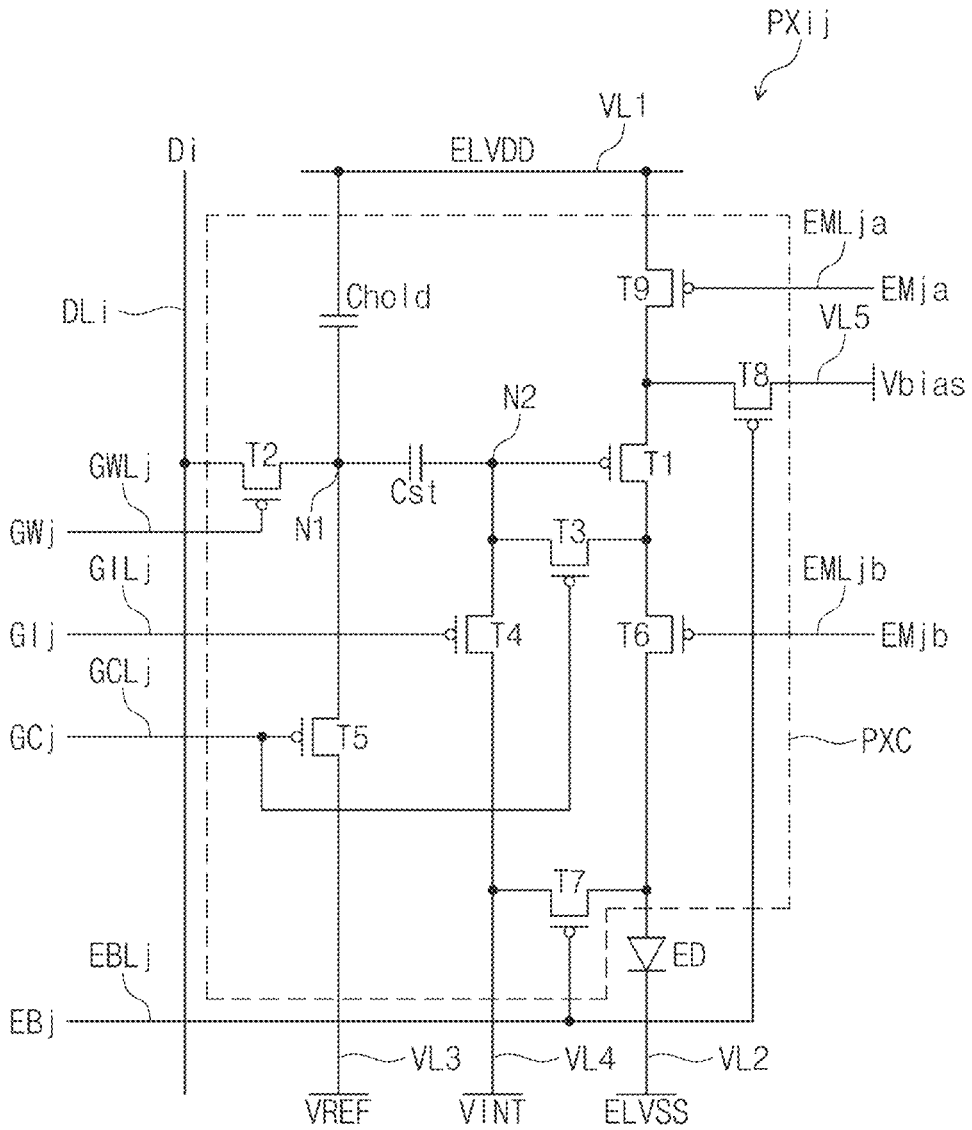
FIG. 2 is a circuit diagram of an embodiment of a pixel according to the invention.

FIG. 2 is a circuit diagram of an embodiment of a pixel according to the invention.

FIG. 2 illustrates a circuit diagram of a pixel PXij connected to an i-th data line DLi (i is a natural number equal to or less than m) of the data lines DL1 to DLm, j-th scan lines GILj, GCLj, GWLj, and EBLj (j is a natural number equal to or less than n) of the scan lines GIL1 to GILn, GCL1 to GCLn, GWL1 to GWLn, and EBL1 to EBLn, and j-th light emission control lines EMLja and EMLjb of the light emission control lines EML1*a* to EMLna and EML1*b* to EMLnb, illustrated in FIG. 1 as an example.

Each of the plurality of pixels PX illustrated in FIG. 1 may have the same circuit configuration as the circuit of the pixel PXij illustrated in FIG. 2.

Referring to FIG. 2, the pixel PXij of a display device in an embodiment includes the pixel circuit PXC and at least one light-emitting diode ED. In this embodiment, an example in which one pixel PXij includes one light-emitting diode ED will be described.

The pixel circuit PXC includes first to ninth transistors T1, T2, T3, T4, T5, T6, T7, T8, and T9 and capacitors Chold and Cst. In this embodiment, each of the first to ninth transistors T1 to T9 is a P-type transistor having a low-temperature polycrystalline silicon ("LTPS") semiconductor layer. In another embodiment, all of the first to ninth transistors T1 to T9 may be N-type transistors. In another embodiment, at least one of the first to ninth transistors T1 to T9 may be a P-type transistor and the rest may be an N-type transistor.

In addition, a circuit configuration of the pixel PXij according to the invention is not limited to FIG. 2. The pixel PXij illustrated in FIG. 2 is only an example, and the circuit configuration of the pixel PXij may be modified.

The scan lines GILj, GCLj, GWLj, and EBLj may transfer the scan signals GIj, GCj, GWj, and EBj, respectively, and the light emission control lines EMLja and EMLjb may transfer the light emission control signals EMja and EMjb. The data line DLi transfers a data signal Di. The data signal Di may have a voltage level corresponding to the image signal RGB input to the display device DD (refer to FIG. 1). First to fifth voltage lines VL1 to VL5 may transfer the first driving voltage ELVDD, the second driving voltage ELVSS, the reference voltage VREF, the initialization voltage VINT, and the bias voltage Vbias to the pixel PXij, respectively. In an embodiment, the bias voltage Vbias may be, for example, about 4 volts (V) to about 7V.

The capacitor Chold is connected between the first voltage line VL1 and a first node N1. The capacitor Cst is connected between the first node N1 and a second node N2.

The first transistor T1 includes a first electrode electrically connected to the first voltage line VL1 through the ninth transistor T9, a second electrode electrically connected to an anode of the light-emitting diode ED through the sixth transistor T6, and a gate electrode.

The second transistor T2 includes a first electrode connected to the data line DLi, a second electrode connected to the first node N1, and a gate electrode connected to the scan line GWLj. The second transistor T2 transfers the data signal Di received through the data line DLi to the first node N1 in response to the scan signal GWj received through the scan line GWLj.

The third transistor T3 includes a first electrode connected to the second electrode of the first transistor T1, a second electrode connected to the second node N2, and a gate electrode connected to the scan line GCLj. The third transistor T3 may electrically connect the gate electrode of the first transistor T1 to the second electrode of the first transistor T1 in response to the scan signal GCj received through the scan line GCLj.

The fourth transistor T4 includes a first electrode connected to the second node N2, a second electrode connected to the fourth voltage line (also referred to as an initialization voltage line) VL4, and a gate electrode connected to the scan line GILj. The fourth transistor T4 transfers the initialization voltage VINT received through the fourth voltage line VL4 to the second node N2 in response to the scan signal GIj received through the scan line GILj.

The fifth transistor T5 includes a first electrode connected to the first node N1, a second electrode connected to the third voltage line (also referred to as a reference voltage line) VL3, and a gate electrode connected to the scan line GCLj. The fifth transistor T5 may be turned-on by the scan signal GCj received through the scan line GCLj to transfer the reference voltage VREF to the first node N1.

The sixth transistor T6 includes a first electrode connected to the second electrode of the first transistor T1, a second electrode connected to the anode of the light-emitting diode ED, and a gate electrode connected to the light emission control line EMLjb. The sixth transistor T6 may be turned-on by the light emission control signal EMjb received through the light emission control line EMLjb to electrically connect the second electrode of the first transistor T1 to the light-emitting diode ED.

The seventh transistor T7 includes a first electrode connected to the anode of the light-emitting diode ED, a second electrode connected to the fourth voltage line VL4, and a gate electrode connected to the scan line EBLj. The seventh transistor T7 is turned-on depending on the scan signal EBj received through the scan line EBLj to bypass a current of the anode of the light-emitting diode ED to the fourth voltage line VL4.

The eighth transistor (also referred to as a bias transistor) T8 includes a first electrode connected to the first electrode of the first transistor T1, the second electrode connected to the fifth voltage line VL5, and a gate electrode connected to the scan line EBLj. The eighth transistor T8 may be turned-on by the scan signal EBj received through the scan line EBLj to electrically connect the fifth voltage line VL5 to the first electrode of the first transistor T1.

The ninth transistor (also referred to as a light emission control transistor) T9 includes a first electrode connected to the first voltage line VL1, a second electrode connected to the first electrode of the first transistor T1, and a gate electrode connected to the light emission control line EMLja. The ninth transistor T9 may be turned-on by the light emission control signal EMja received through the light emission control line EMLja to electrically connect the first voltage line VL1 to the first electrode of the first transistor T1.

The light-emitting diode ED includes the anode connected to the second electrode of the sixth transistor T6 and the cathode connected to the second voltage line VL2.

Figure 3A:
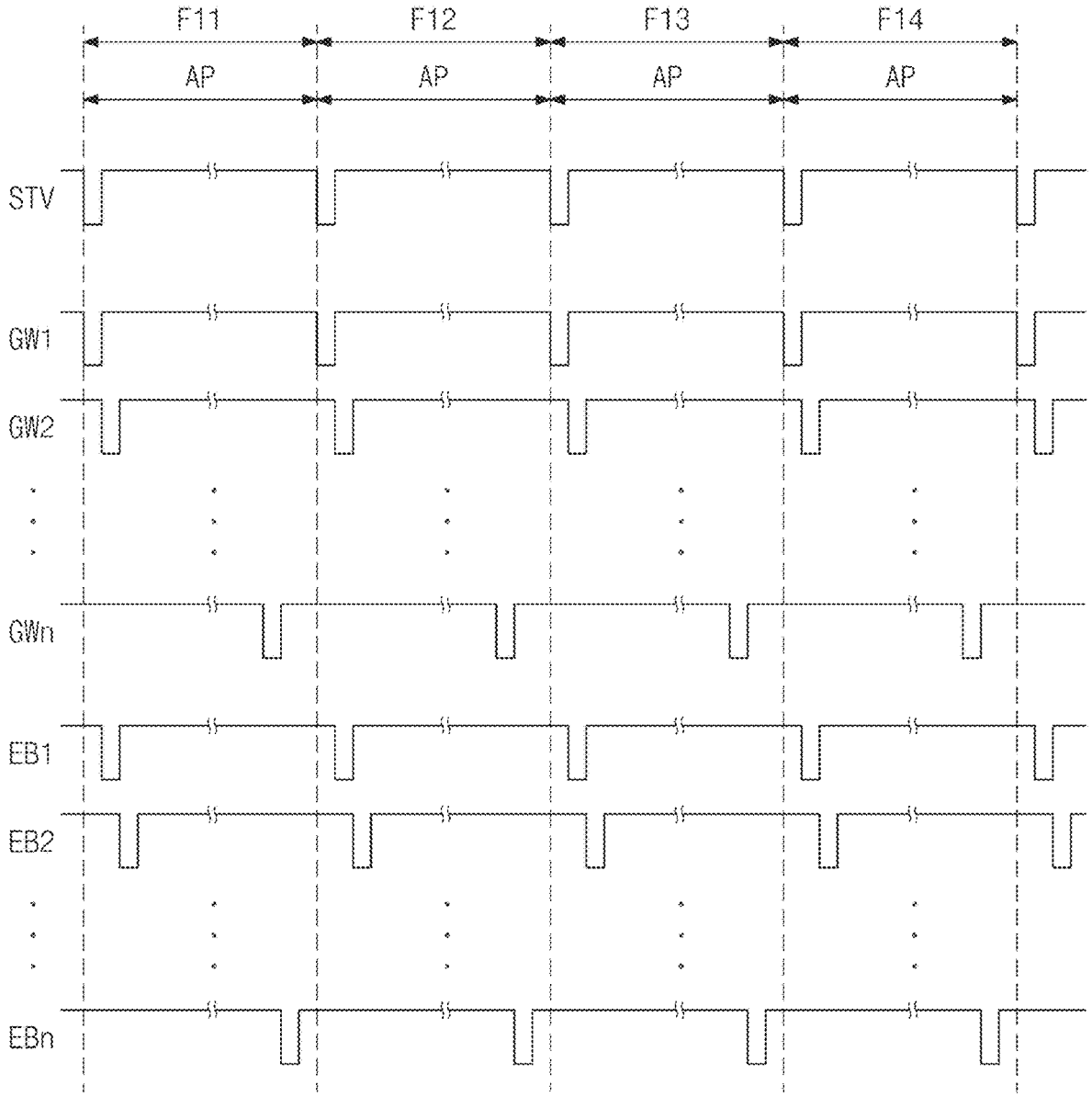
FIGS. 3A, 3B, and 3C are timing diagrams describing an operation of a display device.
Figure 3B:
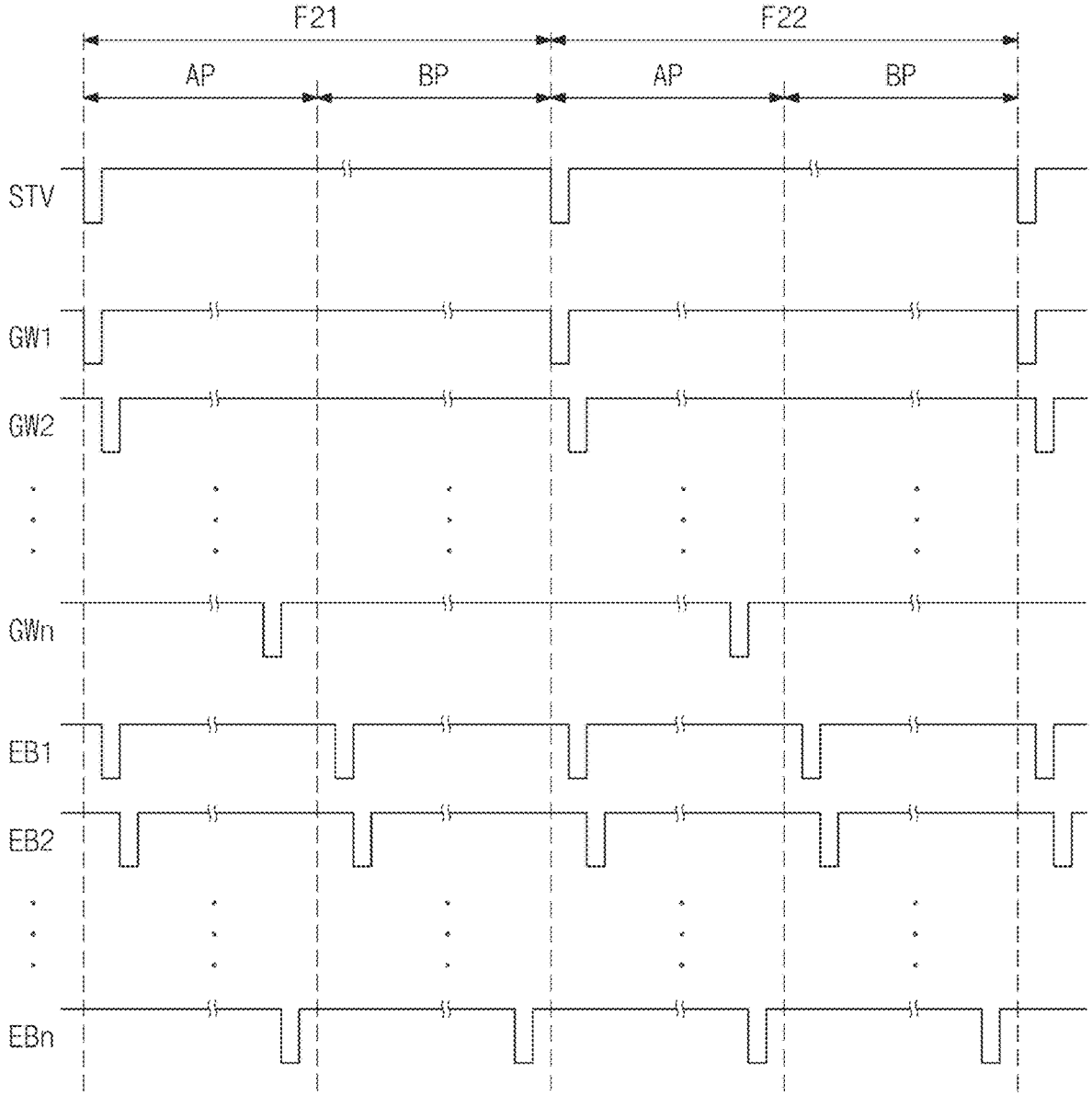
Figure 3C:
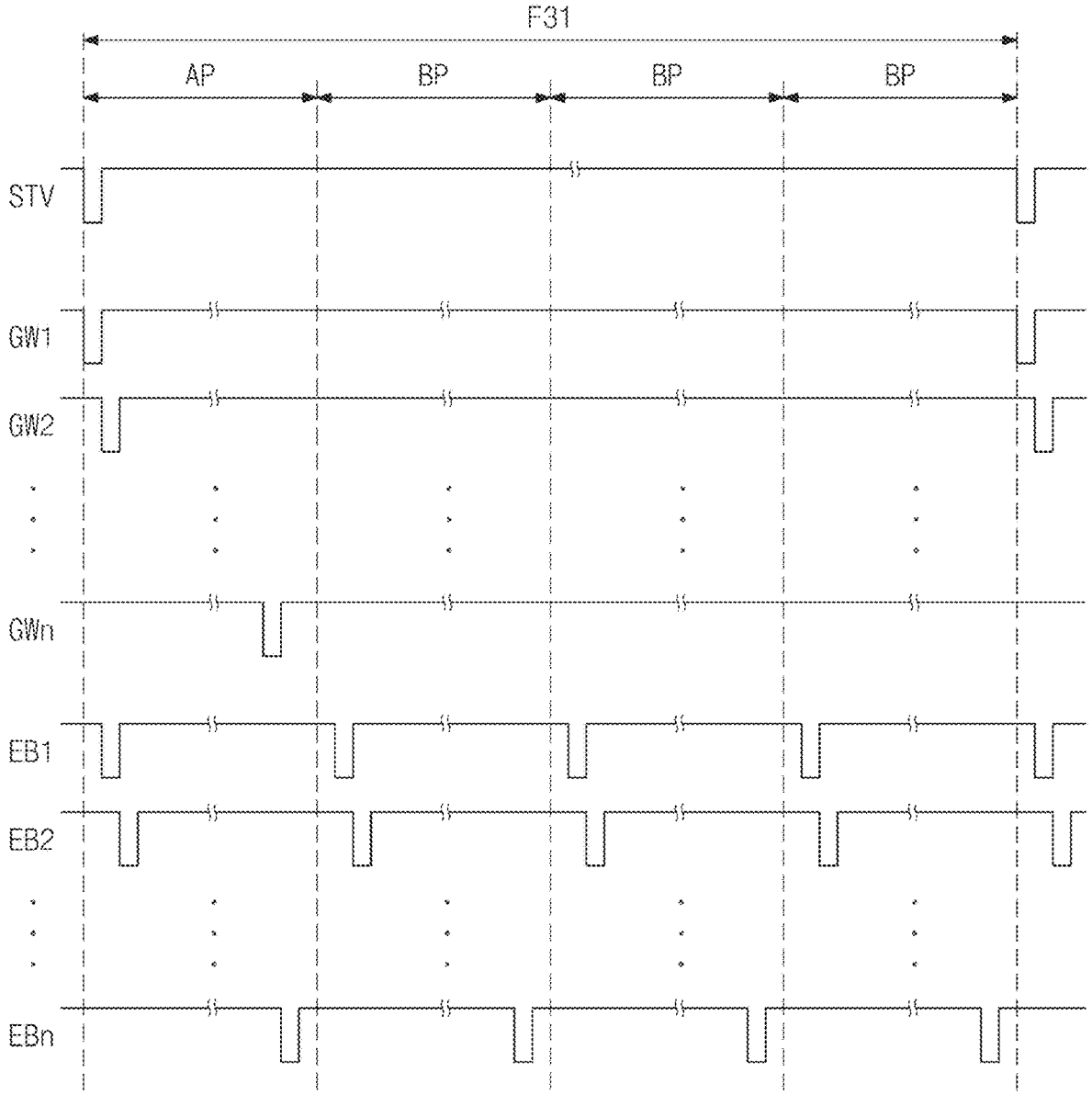

FIGS. 3A, 3B, and 3C are timing diagrams describing an operation of a display device.

Referring to FIGS. 1, 2, 3A, 3B, and 3C, for convenience of description, it is described as an example that the display device DD operates at a first frequency (e.g., about 240 hertz (Hz)), a second frequency (e.g., about 120 Hz), and the third frequency (e.g., about 60 Hz), but the invention is not limited thereto. The driving frequency of the display device DD may be variously changed. In an embodiment, the driving frequency of the display device DD may be selected among the first frequency, the second frequency, and the third frequency depending on a type of the image signal RGB. In addition, the display device DD does not fix the driving frequency to a predetermined frequency during operation, but may change the driving frequency to any one of the first to third frequencies at any time.

The driving controller 100 provides the scan control signal SCS to the scan driving circuit SD. The scan control signal SCS may include information on the driving frequency of the display device DD. The scan driving circuit SD may output the scan signals GC1 to GCn, GI1 to GIn, GW1 to GWn, and EB1 to EBn corresponding to the driving frequency in response to the scan control signal SCS.

FIG. 3A is a timing diagram of scan signals when a driving frequency of the display device DD is the first frequency (e.g., about 240 Hz).

Referring to FIGS. 1 and 3A, when the driving frequency is the first frequency (e.g., about 240 Hz), the scan driving circuit SD sequentially activates the scan signals GW1 to GWn in each of frames F11, F12, F13, and F14 to a low level, and sequentially activates the scan signals EB1 to EBn to a low level. FIG. 3A illustrates only the scan signals GW1 to GWn and the scan signals EB1 to EBn, but the scan signals GI1 to GIn and GC1 to GCn and the light emission control signals EM1*a* to EMna and EM1*b* to EMnb may also be sequentially activated in each of the frames F11, F12, F13, and F14.

FIG. 3B is a timing diagram of scan signals when a driving frequency of the display device DD is the second frequency (e.g., about 120 Hz).

Referring to FIGS. 1 and 3B, when the driving frequency is the second frequency (e.g., about 120 Hz), a duration of each of frames F21 and F22 may be twice a duration of each of the frames F11, F12, F13, and F14 illustrated in FIG. 3A. Each of the frames F21 and F22 may include one active section AP and one blank section BP. The scan driving circuit SD sequentially activates the scan signals GW1 to GWn to a low level during the active section AP and sequentially activates the scan signals EB1 to EBn to a low level during the active section AP. FIG. 3B illustrates only the scan signals GW1 to GWn and the scan signals EB1 to EBn, but the scan signals GI1 to GIn and GC1 to GCn and the light emission control signals EM1*a* to EMna and EM1*b* to EMnb may also be sequentially activated in the active section AP of each of the frames F21 and F22.

The scan driving circuit SD may maintain the scan signals GW1 to GWn at an inactive level (e.g., a high level) during the blank section BP, and may sequentially activate the scan signals EB1 to EBn.

Although not illustrated in FIG. 3B, the scan driving circuit SD may maintain the scan signals GI1 to GIn and GC1 to GCn at an inactive level (e.g., a high level) during the blank section BP. The light emission driving circuit EDC may sequentially activate the light emission control signals EM1*a* to EMna and EM1*b* to EMnb during the blank section BP.

In the example illustrated in FIG. 3A described above, each of the frames F11, F12, F13, and F14 may correspond to the active section AP illustrated in FIG. 3B.

FIG. 3C is a timing diagram of a start signal STV and scan signals when a driving frequency of the display device DD is the third frequency (e.g., about 60 Hz).

Referring to FIGS. 1 and 3C, when the driving frequency is the third frequency (e.g., about 60 Hz), a duration of a frame F31 may be twice a duration of each of the frames F21 and F22 illustrated in FIG. 3B. The duration of the frame F31 may be four times the duration of each of the frames F11, F12, F13, and F14 illustrated in FIG. 3A.

The frame F31 may include one active section AP and three blank sections BP. The scan driving circuit SD sequentially activates the scan signals GW1 to GWn to a low level during the active section AP and sequentially activates the scan signals EB1 to EBn to a low level. FIG. 3C illustrates only the scan signals GW1 to GWn and the scan signals EB1 to EBn, but the scan signals GI1 to GIn and GC1 to GCn and the light emission control signals EM1*a* to EMna and EM1*b* to EMnb may also be sequentially activated in the active section AP of the frame F31.

The scan driving circuit SD may maintain the scan signals GW1 to GWn at an inactive level (e.g., a high level) during the blank section BP, and may sequentially activate the scan signals EB1 to EBn.

Although not illustrated in FIG. 3C, the scan driving circuit SD may maintain the scan signals GI1 to GIn and GC1 to GCn at an inactive level (e.g., a high level) during the blank section BP. The light emission driving circuit EDC may sequentially activate the light emission control signals EM1*a* to EMna and EM1*b* to EMnb during the blank section BP.

Figure 4:
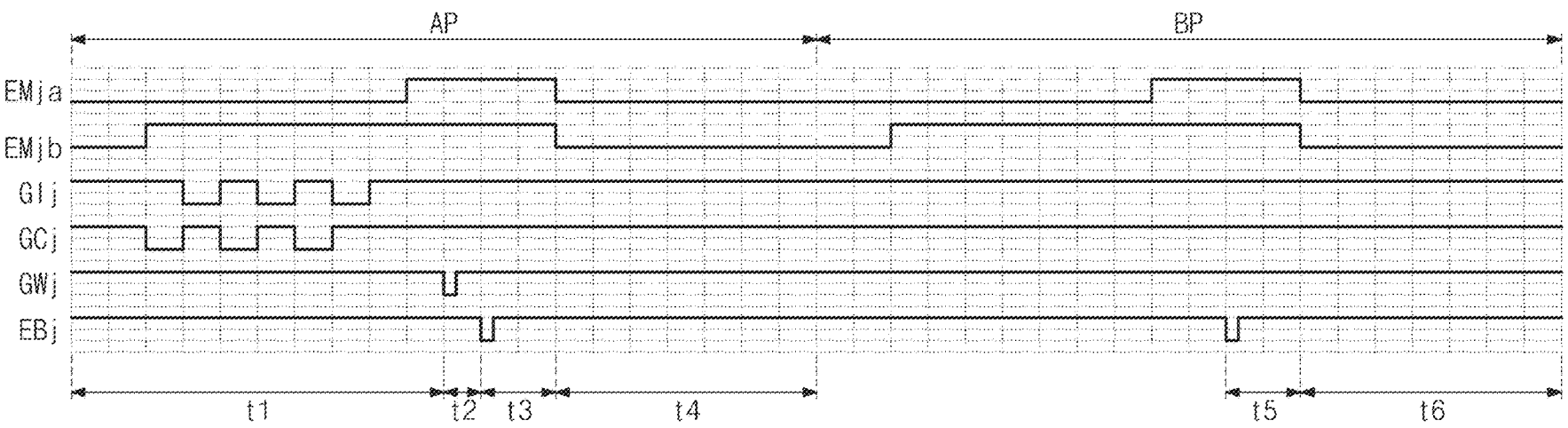
FIG. 4 is a timing diagram describing an operation of an active section and a blank section of a pixel illustrated in FIG. 2.

FIG. 4 is a timing diagram describing an operation of the active section AP and the blank section BP of a pixel illustrated in FIG. 2.

Referring to FIG. 4, the active section AP may include first to fourth sections t1 to t4, and the blank section BP may include fifth and sixth sections t5 and t6.

Referring to FIGS. 2 and 4, during a first section t1 of the active section AP, the light emission control signal EMja is at an active level (e.g., a low level), and the light emission control signal EMjb is at an inactive level (e.g., a high level). In detail, during the initialization section, the ninth transistor T9 is turned-on and the sixth transistor T6 is turned-off.

When the scan signal GIj transitions to an active level (e.g., a low level) during the first section t1, the fourth transistor T4 is turned-on so that the initialization voltage VINT is transferred to the second node N2. The first transistor T1 may be turned-on while the scan signal GIj is at an active level.

When the scan signal GCj transitions to the active level during the first section t1, the third transistor T3 is turned-on so that the gate electrode of the first transistor T1 may be electrically connected to the second electrode of the first transistor T1. When the first transistor T1 is turned-on by the initialization voltage VINT, a compensation voltage ELVDD−Vth corresponding to a difference between the first driving voltage ELVDD and a threshold voltage Vth of the first transistor T1 may be provided to the second node N2.

When the scan signal GCj transitions to an active level (e.g., a low level) during the first section t1, the fifth transistor T5 is turned-on so that the reference voltage VREF is transferred to the first node N1.

Therefore, as the scan signals GIj and GCj alternately transition to the active level, the reference voltage VREF may be applied to the first node N1 which is one end of the capacitor Cst, the compensation voltage ELVDD−Vth may be applied to the second node N2 which is the other end of the capacitor Cst. The first driving voltage ELVDD and the reference voltage VREF may be applied to both ends of the capacitor Chold, respectively.

The first section t1 may be an initialization and compensation section for initializing the gate electrode of the first transistor T1 and compensating for the threshold voltage Vth of the first transistor T1.

As the scan signals GIj and GCj alternately transition to the active level several times in the first section t1, a voltage of the gate electrode of the first transistor T1 may be set to the compensation voltage ELVDD−Vth. Accordingly, it is possible to minimize the voltage across the capacitor Cst and the voltage of the gate electrode of the first transistor T1 being affected by the data signal Di of a previous frame.

When the second section t2 starts, the light emission control signal EMj a transitions to the inactive level, and the scan signal GWj transitions to the active level. When the scan signal GWj transitions to the active level, the second transistor T2 is turned-on. The voltage of the data signal Di provided to the data line DLi, that is, a data voltage Vdata, may be transferred to the first node N1 through the second transistor T2.

As a voltage of the first node N1 changes from the reference voltage VREF to a voltage VREF−Vdata reduced by the data voltage Vdata, a voltage provided to the gate electrode of the first transistor T1 through the capacitor Cst is changed to a sum of the compensation voltage ELVDD−Vth and the voltage VREF-Vdata. That is, the voltage of the gate electrode of the first transistor T1 is ELVDD−Vth+VREF−Vdata.

The second section t2 may be a writing section in which the data voltage Vdata corresponding to the data signal Di is written into the capacitor Cst.

In the third section t3, as the scan signal EBj transitions to the active level, the seventh transistor T7 and the eighth transistor T8 are turned-on.

When the seventh transistor T7 is turned-on, a current of the anode of the light-emitting diode ED may be bypassed to the fourth voltage line VL4. When the eighth transistor T8 is turned-on, the bias voltage Vbias may be applied to the first electrode of the first transistor T1.

In this embodiment, it is illustrated and described that the scan signal EBj is commonly provided to the gate electrode of the seventh transistor T7 and the gate electrode of the eighth transistor T8, but the invention is not limited thereto. In an embodiment, the scan signals provided to the gate electrode of the seventh transistor T7 and the gate electrodes of the eighth transistor T8 may be different from each other.

The third section t3 may be a bypass section in which the current of the anode of the light-emitting diode ED is bypassed to the fourth voltage line VL4.

All of the scan signals GIj, GCj, GWj, and EBj may be maintained at an inactive level during the fourth section t4. When the fourth section t4 starts, the light emission control signals EMja and EMjb transition to the active level. As the ninth transistor T9 and the sixth transistor T6 are turned-on by the light emission control signals EMja and EMjb, a current path may be defined between the first voltage line VL1 and the light-emitting diode ED through the ninth transistor T9, the first transistor T1, and the sixth transistor T6.

A current flowing through the light-emitting diode ED is proportional to a voltage $(V_{GS}-Vth)^2$, which is the square of a difference between the gate-source voltage $V_{GS}$ of the first transistor T1 and the threshold voltage Vth of the first transistor T1. Since a voltage level of the gate electrode of the first transistor T1 is the voltage level (ELVDD−Vth+VREF−Vdata), the current flowing through the light-emitting diode ED is proportional to a voltage $(VREF-Vdata)^2$, which is the square of a difference between the reference voltage VREF and the data voltage Vdata corresponding to the data signal Di. That is, the threshold voltage Vth of the first transistor T1 may not affect the current flowing through the light-emitting diode ED. The fourth section t4 may be a light emission section of the light-emitting diode ED.

In the fifth section t5 of the blank section BP, the light emission control signals EMja and EMjb and the scan signals GIj, GCj, and GWj may be maintained at an inactive level.

When the scan signal EBj transitions to the active level in the fifth section t5 of the blank section BP, the seventh transistor T7 and the eighth transistor T8 are turned-on.

When the seventh transistor T7 is turned-on, the current of the anode of the light-emitting diode ED may be bypassed to the fourth voltage line VL4. When the eighth transistor T8 is turned-on, the bias voltage Vbias may be applied to the first electrode of the first transistor T1. As the bias voltage Vbias is provided to the first electrode of the first transistor T1 in the blank section BP, a luminance deviation due to a hysteresis characteristic of the first transistor T1 may be reduced.

The fifth section t5 may be a bias section in which the bias voltage Vbias is provided to the first electrode of the first transistor T1.

All of the scan signals GIj, GCj, GWj, and EBj may be maintained at an inactive level during the sixth section t6. When the sixth section t6 starts, the light emission control signals EMja and EMjb transition to the active level. As the ninth transistor T9 and the sixth transistor T6 are turned-on by the light emission control signals EMja and EMjb, a current path may be defined between the first voltage line VL1 and the light-emitting diode ED through the ninth transistor T9, the first transistor T1, and the sixth transistor T6. The first transistor T1 may maintain a turned-on state by the charges charged by the capacitors Cst and Chold.

Figure 5A:
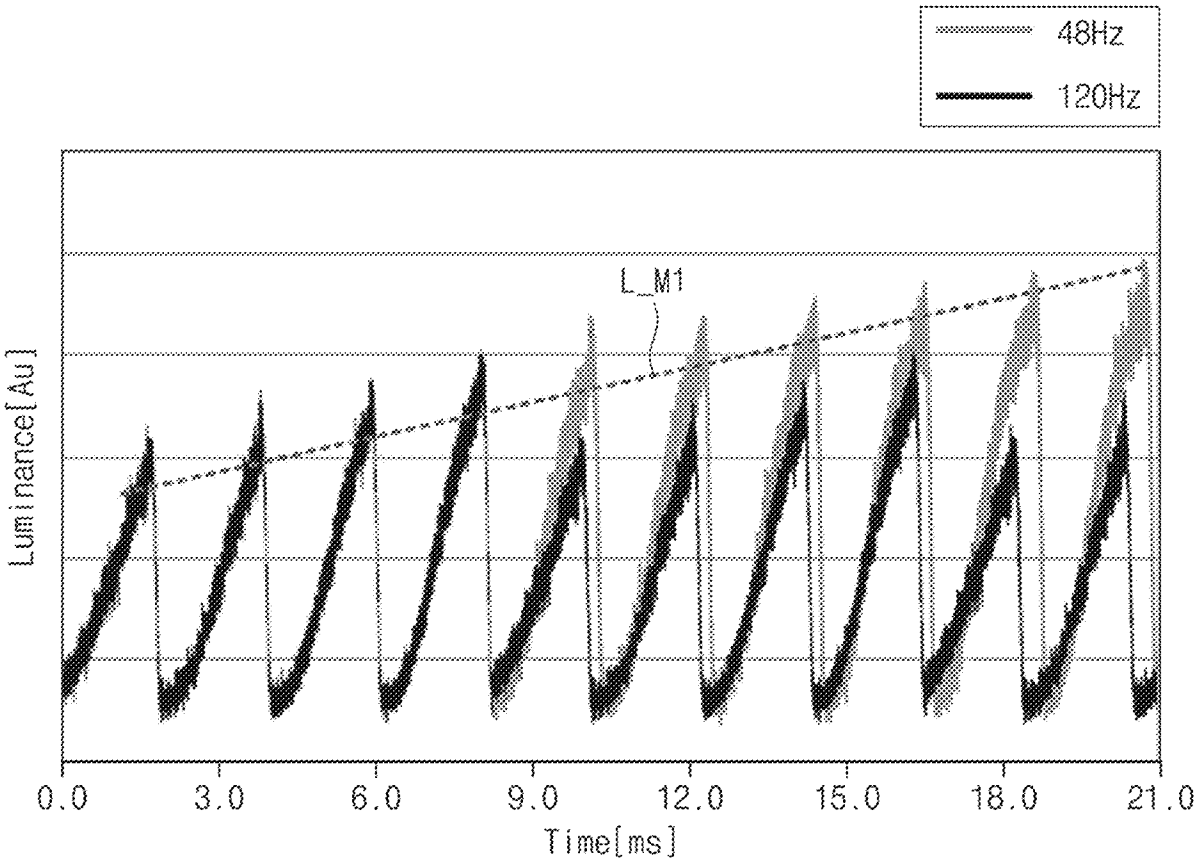
FIGS. 5A, 5B, and 5C illustrate experimental results associated with an operation of a pixel when a bias voltage is not provided to a first electrode of a first transistor.
Figure 5B:
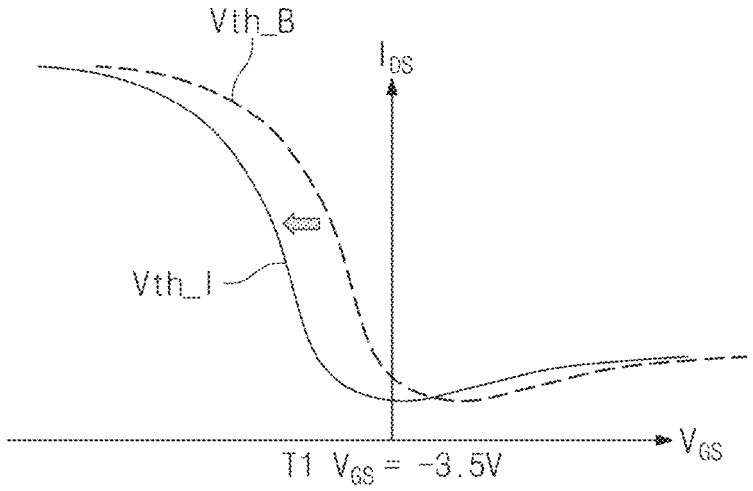
Figure 5C:
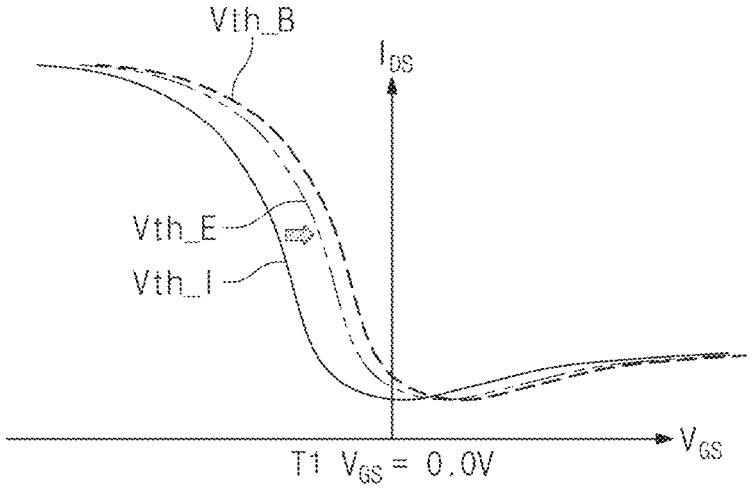

FIGS. 5A, 5B and 5C illustrate experimental results associated with an operation of a pixel when the bias voltage Vbias is not provided to a first electrode of the first transistor T1. In FIG. 5A, an x-axis may represent time in terms of a microsecond (μs) and a y-axis may represent luminance in terms of an arbitrary unit (Au). In FIGS. 5B and 5C, an x-axis may represent a magnitude of a gate-source voltage $V_{GS}$ of the first transistor T1 and a y-axis may represent a magnitude of a drain-source current IDS of the first transistor T1.

Referring to FIGS. 4 and 5A, when the bias voltage Vbias is not provided to the first electrode of the first transistor T1 in the fifth section t5, as an operation time of the pixel PX increases, an emission luminance of the pixel PX tends to increase.

When the driving frequency of the pixel PX is a high frequency (e.g., about 120 Hz), the luminance change according to the operation time of the pixel PX is not large.

In FIG. 5A, a dotted line L_M1 indicates an average luminance change of the light emission section (e.g., the fourth section t4 in FIG. 4) when the pixel PX operates at a low frequency (e.g., about 48 Hz). When the driving frequency of the pixel PX is the low frequency (e.g., about 48 Hz), as the operation time of the pixel PX increases, the emission luminance of the pixel PX increases.

When the driving frequency of the pixel PX is alternately changed between a low frequency (e.g., about 48 Hz) and a high frequency (e.g., about 120 Hz), as the operation time of the pixel PX increases, a luminance difference may be recognized by a user.

Referring to FIG. 5B, the gate-source voltage $V_{GS}$ of the first transistor T1 may be about −3.5V during the initialization section (e.g., the first section t1 of FIG. 4). In this case, the threshold voltage Vth of the first transistor T1 may be changed to a negatively shifted threshold voltage Vth_I from a base threshold voltage Vth_B.

Referring to FIG. 5C, when the bias voltage Vbias is not provided during the bias section (e.g., the fifth section t5 of FIG. 4), the gate-source voltage $V_{GS}$ of the first transistor T1 may be about −0.0V during the light emission section (e.g., the sixth section t6 of FIG. 4). In this case, the threshold voltage Vth of the first transistor T1 may be changed to a threshold voltage Vth_E. When a change width of the threshold voltage Vth of the first transistor T1 is large, flicker may be recognized by a user.

Figure 6A:
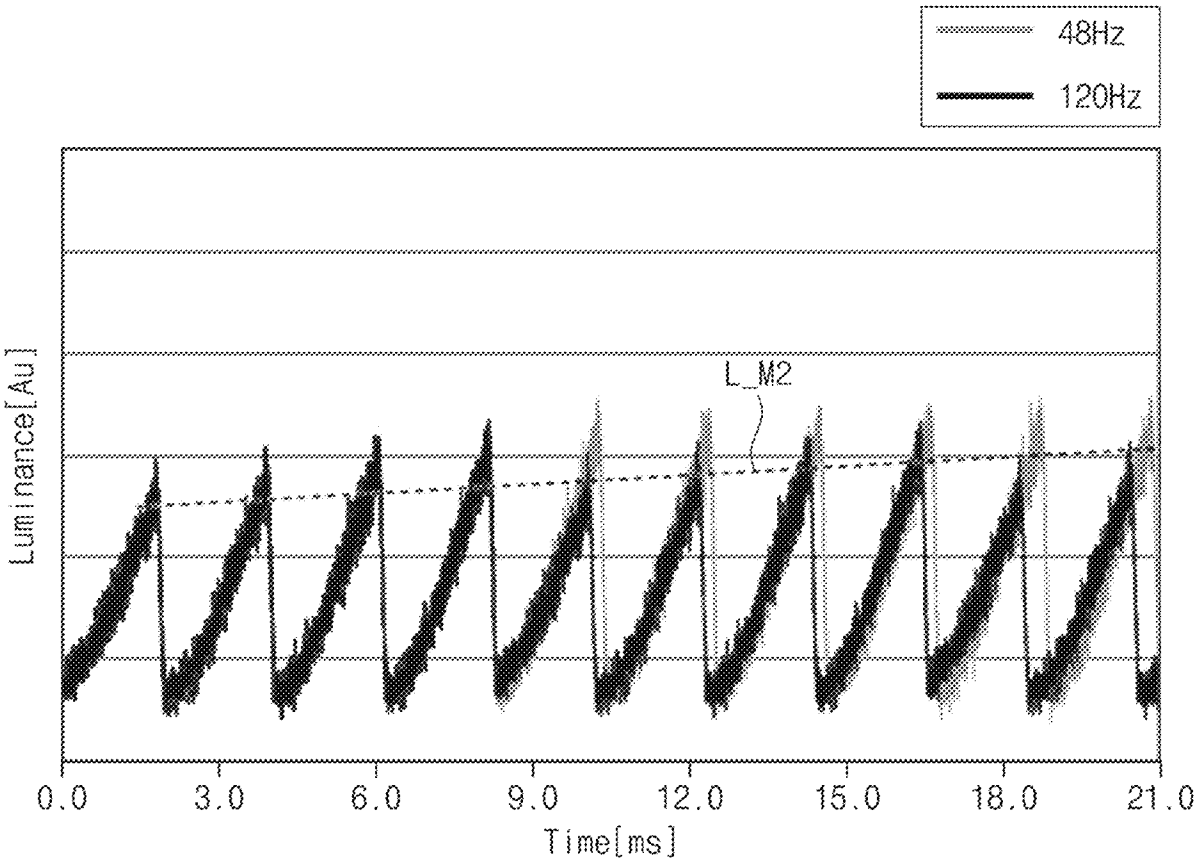
FIGS. 6A, 6B, and 6C illustrate experimental results associated with an operation of a pixel when a bias voltage is applied to a first electrode of a first transistor.
Figure 6B:
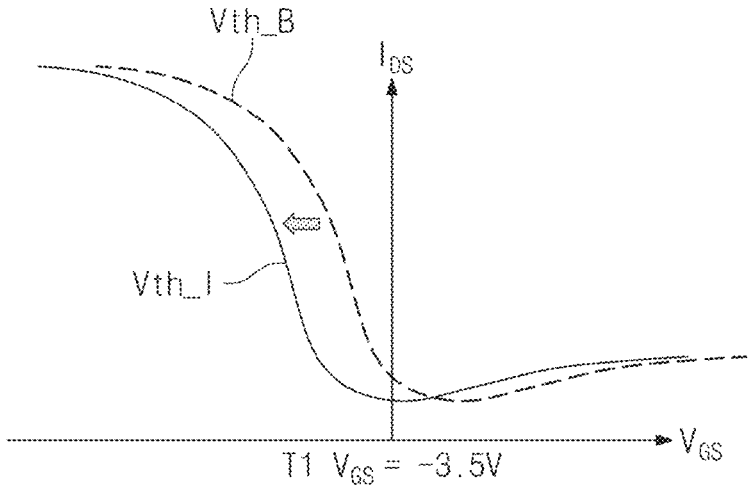
Figure 6C:
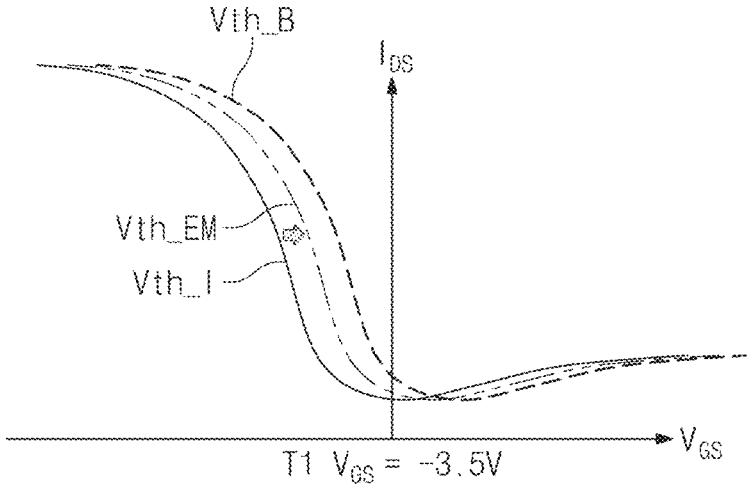

FIGS. 6A, 6B and 6C illustrate experimental results associated with an operation of a pixel when the bias voltage Vbias is applied to a first electrode of the first transistor T1.

Referring to FIGS. 4 and 6A, when the driving frequency of the pixel PX is a high frequency (e.g., about 120 Hz), the luminance change according to the operation time of the pixel PX is not large.

In FIG. 6A, a dotted line L_M2 indicates an average luminance change of the light emission section (e.g., the fourth section t4 of FIG. 4) when the pixel PX operates at a low frequency (e.g., about 48 Hz). When the driving frequency of the pixel PX is the low frequency (e.g., about 48 Hz), as the operation time of the pixel PX increases, the emission luminance of the pixel PX may slightly increase.

The average luminance change L_M2 illustrated in FIG. 6A has a gentle slope compared to the average luminance change L_M1 illustrated in FIG. 5A. Therefore, even when the driving frequency of the pixel PX is alternately changed between the low frequency (e.g., about 48 Hz) and the high frequency (e.g., about 120 Hz), the luminance difference may not be recognized by a user.

Referring to FIG. 6B, during the initialization section (e.g., the first section t1 of FIG. 4), the gate-source voltage $V_{GS}$ of the first transistor T1 may be about −3.5V. In this case, the threshold voltage Vth of the first transistor T1 may be changed to the negatively shifted threshold voltage Vth_I from the base threshold voltage Vth_B.

Referring to FIG. 6C, when the bias voltage Vbias) is provided during the bias section (e.g., the fifth section t5 of FIG. 4), the gate-source voltage $V_{GS}$ of the first transistor T1 may be about −3.5V during the light emission section (e.g., the sixth section t6 of FIG. 4). In this case, the threshold voltage Vth of the first transistor T1 may change to a threshold voltage Vth_EM.

In the example illustrated in FIG. 5C, the threshold voltage Vth of the first transistor T1 is changed from the threshold voltage Vth_I to the threshold voltage Vth_E, but in the example illustrated in FIG. 6C, the threshold voltage Vth of the first transistor T1 is changed from the threshold voltage Vth_I to the threshold voltage Vth_EM.

When the bias voltage Vbias is provided during the bias section (e.g., the fifth section t5 of FIG. 4), the width of change in the threshold voltage Vth of the first transistor T1 may be minimized. Therefore, a display quality of the display device DD (refer to FIG. 1) may be improved.

Figure 7:
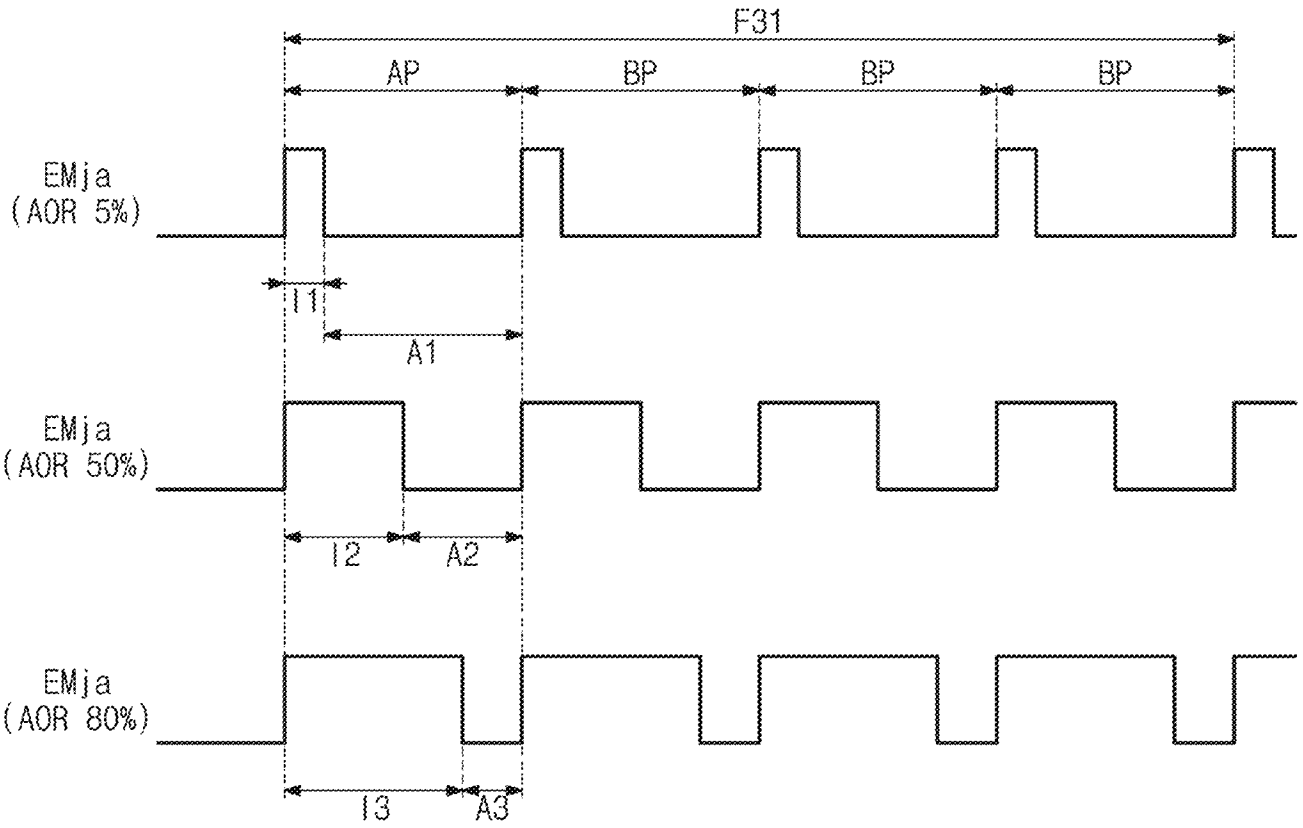
FIG. 7 is a diagram illustrating a method of adjusting a luminance of a pixel by changing a pulse width of a light emission control signal.

FIG. 7 is a diagram illustrating a method of adjusting a luminance of a pixel by changing a pulse width of a light emission control signal.

In FIG. 7, for convenience of description, as illustrated in FIG. 3C, the light emission control signal EMja is illustrated when the driving frequency of the display device DD is a third frequency (e.g., about 60 Hz).

Referring to FIGS. 2, 4 and 7, the light emission control signal EMja may be activated to the active level (e.g., the low level) in the blank section BP as well as the active section AP of one frame F31.

The driving controller 100 illustrated in FIG. 1 may provide the light emission driving control signal ECS corresponding to the dimming mode to the light emission driving circuit EDC. The light emission driving circuit EDC may output the light emission control signals EM1*a* to EMna and EM1*b* to EMnb to the light emission control lines EML1*a* to EMLna and EML1*b* to EMLnb in response to the light emission driving control signal ECS from the driving controller 100.

The dimming mode refers to a mode for adjusting a luminance of the display device DD, and the luminance of the display device DD may be adjusted depending on a light emission ratio AOR (also referred to as an active-matrix organic light-emitting diode impulsive driving ("AID") off ratio). The light emission ratio AOR may mean a ratio of a non-emitting period in which the active-matrix organic light-emitting diode is turned-off in a frame to a period of the frame. In an embodiment, as the light emission ratio AOR increases, the luminance of the display device DD decreases, for example.

FIG. 7 illustrates the j-th light emission control signal EMja when the light emission ratio AOR is about 5 percent (%), about 50%, and about 80%. The light emission driving circuit EDC may output the light emission control signals EM1*a* to EMna and EM1*b* to EMnb in the same manner as the j-th light emission control signal EMj a.

The light emission control signal EMja illustrated in FIG. 7 is a simple representation of the light emission control signal EMja illustrated in FIG. 4 for convenience of description.

When the light emission ratio AOR is about 5%, the active section AP of the light emission control signal EMja may include a first section I1 and a second section A1.

When the light emission ratio AOR is about 50%, the active section AP of the light emission control signal EMja may include a first section I2 and a second section A2.

When the light emission ratio AOR is about 80%, the active section AP of the light emission control signal EMja may include a first section I3 and a second section A3.

Each of the first sections I1, I2, and I3 may be a time during which the scan signal EBj illustrated in FIG. 4 is maintained at an inactive level (e.g., a high level) after the scan signal EBj transitions from an active level (e.g., a low level) to the inactive level (e.g., high level), that is, a time until the light emission control signal EMja transitions to the active level (e.g., the low level).

Each of the second sections A1, A2, and A3 may be a time during which the light emission control signal EMja is maintained at the active level (e.g., the low level) after the light emission control signal EMja transitions from the inactive level (e.g., the high level) to the active level (e.g., the low level).

In the example illustrated in FIG. 7, it may be seen that as the light emission ratio AOR increases from about 5%, to about 50% and about 80%, the first section of the light emission control signal EMja increases (I1<I2<I3), and the second section of the light emission control signal EMja decreases (A1>A2>A3).

In the examples illustrated in FIGS. 2 and 4, during the fourth section t4 in which the light emission control signal EMja and the light emission control signal EMjb are maintained at the active level, the ninth transistor T9 and the sixth transistor T6 are turned-on to supply a current to the light-emitting diode ED, so that the light-emitting diode ED may emit light.

Therefore, as the light emission ratio AOR increases, the light emission time of the light-emitting diode ED decreases, so that the luminance of the light-emitting diode ED decreases.

As the light emission ratio AOR increases, the first section of the light emission control signal EMja increases (I1<I2<I3).

In the examples illustrated in FIGS. 2 and 4, after the bias voltage Vbias is provided to the first electrode of the first transistor T1 in the fifth section t5 of the blank section BP, as a time when the light emission control signal EMja is activated to the active level is delayed, the threshold voltage Vth of the first transistor T1 may return to the base threshold voltage Vth_B direction from the negatively shifted threshold voltage Vth_I as illustrated in FIG. 5C.

Figure 8:
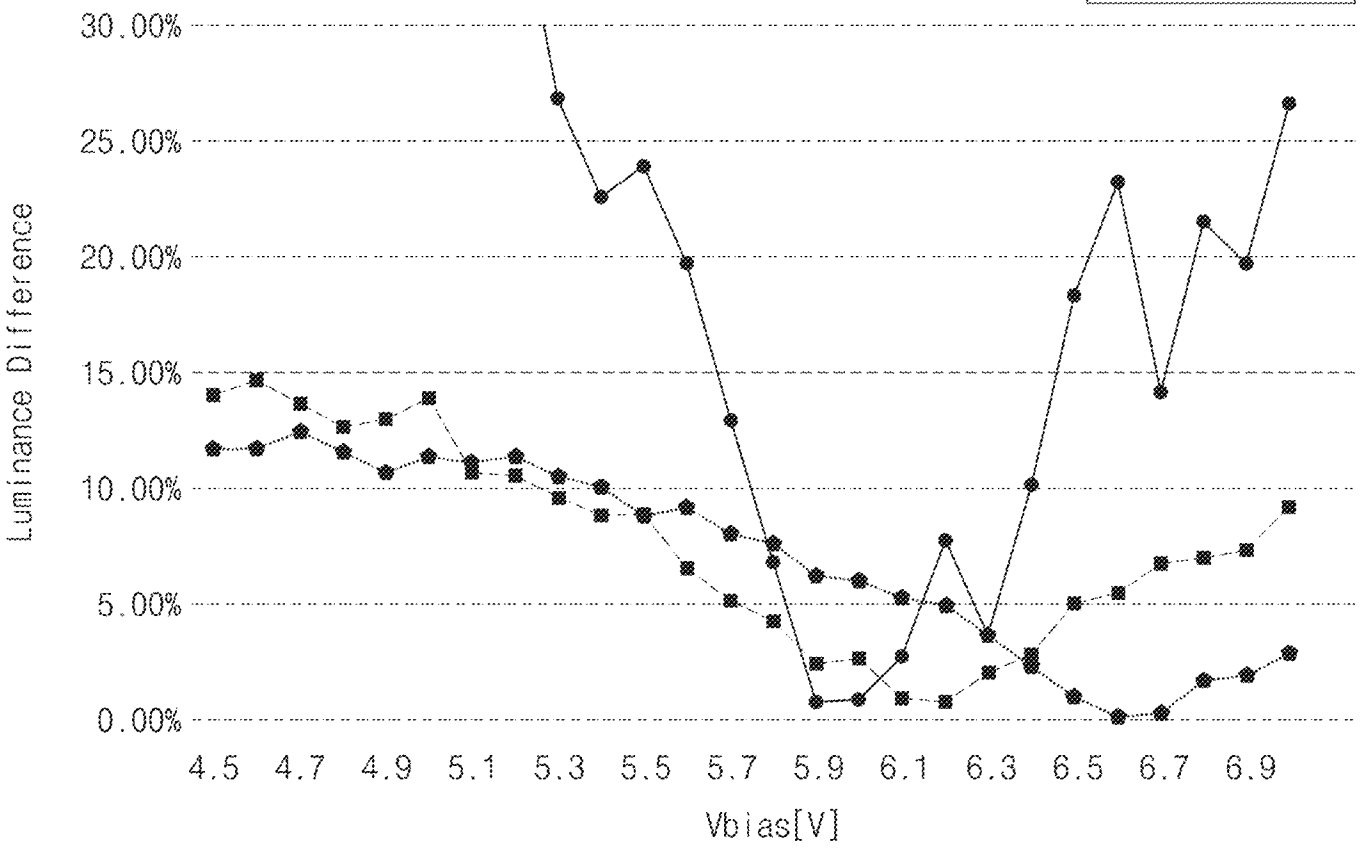
FIG. 8 is a graph illustrating a relationship between a bias voltage and a luminance difference, based on a light emission ratio.

FIG. 8 is a graph illustrating a relationship between the bias voltage Vbias and a luminance difference, based on the light emission ratio AOR. In FIG. 8, an x-axis represents a magnitude of the bias voltage Vbias in terms of a volt (V) and a y-axis represent a luminance difference in terms of a percentage (%).

In FIG. 8, the luminance difference means a difference between a luminance of the display device when the driving frequency is a low frequency (e.g., about 48 Hz) and a luminance of the display device when the driving frequency is a high frequency (e.g., about 120 Hz). The bias voltage Vbias may be selected as a voltage level with a minimum luminance difference.

In an embodiment, when the light emission ratio AOR is about 3%, a voltage of about 6.6V when the luminance difference is the minimum value may be selected as the bias voltage Vbias, for example. When the light emission ratio AOR is about 20%, a voltage of about 6.2V when the luminance difference is the minimum value may be selected as the bias voltage Vbias. When the light emission ratio AOR is about 50%, a voltage of about 5.9V when the luminance difference is the minimum value may be selected as the bias voltage Vbias.

In detail, a voltage level of the bias voltage Vbias is desired to be set differently depending on the light emission ratio AOR. By setting the voltage level of the bias voltage Vbias differently depending on the light emission ratio AOR, it is possible to minimize that the threshold voltage Vth of the first transistor T1 returns to the base threshold voltage Vth_B from the negatively shifted threshold voltage Vth_I.

However, it is not easy to change the voltage level of the bias voltage Vbias depending on the light emission ratio AOR in the dimming mode.

Figure 9:
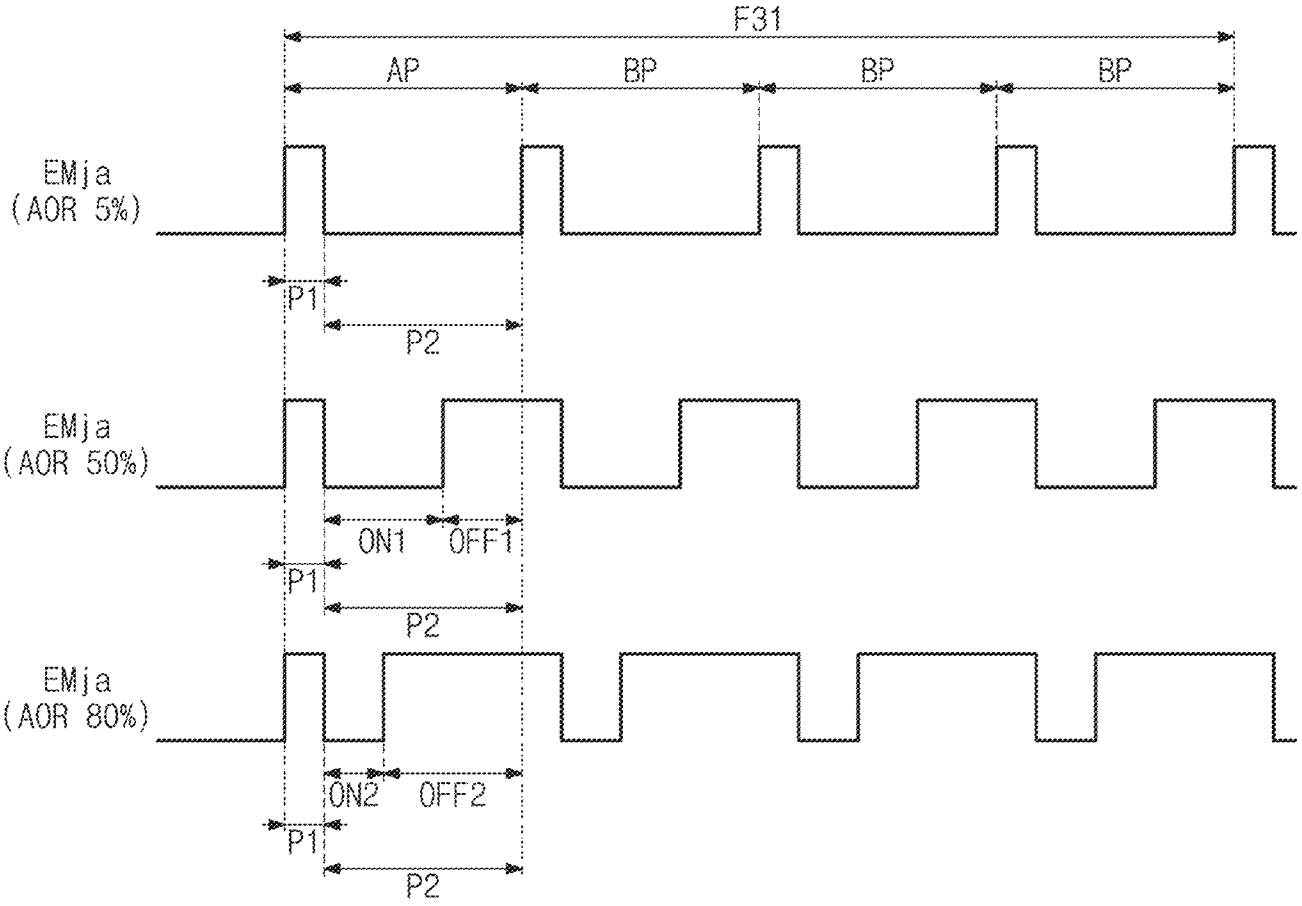
FIG. 9 is a diagram illustrating a method of adjusting a luminance of a pixel by changing a pulse width of a light emission control signal.

FIG. 9 is a diagram illustrating a method of adjusting a luminance of a pixel by changing a pulse width of a light emission control signal.

In FIG. 9, for convenience of description, the light emission control signal EMja is illustrated when the driving frequency of the display device DD is a third frequency (e.g., about 60 Hz) as illustrated in FIG. 3C.

Referring to FIGS. 2, 4 and 9, the light emission control signal EMja may be activated at an active level (e.g., the low level) in the blank section BP as well as the active section AP of one frame F31.

The driving controller 100 illustrated in FIG. 1 may provide the light emission driving control signal ECS corresponding to the dimming mode to the light emission driving circuit EDC. The light emission driving circuit EDC may output the light emission control signals EM1*a* to EMna and EM1*b* to EMnb to the light emission control lines EML1*a* to EMLna and EML1*b* to EMLnb in response to the light emission driving control signal ECS from the driving controller 100.

The dimming mode refers to a mode for controlling the luminance of the display device DD, and the luminance of the display device DD may be adjusted depending on the light emission ratio AOR. In an embodiment, as the light emission ratio AOR increases, the luminance of the display device DD decreases, for example.

FIG. 9 illustrates the j-th light emission control signal EMja when the light emission ratio AOR is about 5%, about 50%, and about 80%. The light emission driving circuit EDC may output the light emission control signals EM1*a* to EMna and EM1*b* to EMnb in the same manner as the j-th light emission control signal EMj a.

The light emission control signal EMja illustrated in FIG. 9 is a simple representation of the light emission control signal EMja illustrated in FIG. 4 for convenience of description.

The active section AP of the light emission control signal EMja may include a first section P1 and a second section P2.

The first section P1 may be a time during which the scan signal EBj illustrated in FIG. 4 is maintained at an inactive level (e.g., a high level) after the scan signal EBj transitions from an active level (e.g., a low level) to the inactive level (e.g., high level), that is, a time until the light emission control signal EMja transitions to the active level (e.g., the low level).

The second section P2 may be a time during which the light emission control signal EMja is maintained at the active level (e.g., the low level) after the light emission control signal EMja transitions from the inactive level (e.g., the high level) to the active level (e.g., the low level).

Even when the light emission ratio AOR is changed, the maintaining time of the first section P1 of the light emission control signal EMja may be uniformly maintained. Similar to as described above, even when the light emission ratio AOR is changed, the maintaining time of the second section P2 of the light emission control signal EMja may be uniformly maintained.

The second section P2 may include a light-emission-on section and a light-emission-off section.

When the light emission ratio AOR is about 5%, the second section P2 of the light emission control signal EMja may be the light-emission-on section.

When the light emission ratio AOR is about 50%, the second section P2 of the light emission control signal EMja may include a light-emission-on section ON1 and a light-emission-off section OFF1.

When the light emission ratio AOR is about 80%, the second section P2 of the light emission control signal EMja may include a light-emission-on section ON2 and a light-emission-off section OFF2.

In the example illustrated in FIG. 9, as the light emission ratio AOR increases from about 5%, to about 50% and about 80%, it may be seen that the light-emission-on section of the light emission control signal EMja decreases (P2>ON1>ON2), and the light-emission-off section of the light emission control signal EMja increases (0<OFF1<OFF2).

In the example illustrated in FIGS. 2 and 4, during the fourth section t4 in which the light emission control signal EMja and the light emission control signal EMjb are maintained at the active level, the ninth transistor T9 and the sixth transistor T6 are turned-on to supply a current to the light-emitting diode ED, so that the light-emitting diode ED may emit light.

Therefore, as the light emission ratio AOR increases, the light emission time of the light-emitting diode ED decreases, so that the luminance of the light-emitting diode ED decreases.

The first section P1 of the light emission control signal EMja is uniform regardless of the light emission ratio AOR. In detail, after the scan signal EBj transitions from an active level (e.g., a low level) to an inactive level (e.g., a high level), a time at which the light emission control signal EMja transitions to an active level (e.g., a low level) is uniform regardless of the light emission ratio AOR.

Accordingly, after the bias voltage Vbias is applied to the first electrode of the first transistor T1, the driving current may be provided to the light-emitting diode ED before the threshold voltage Vth of the first transistor T1 returns to the base threshold voltage Vth_B from the negatively shifted threshold voltage Vth_I, as illustrated in FIGS. 5A to 5C.

Figure 10A:
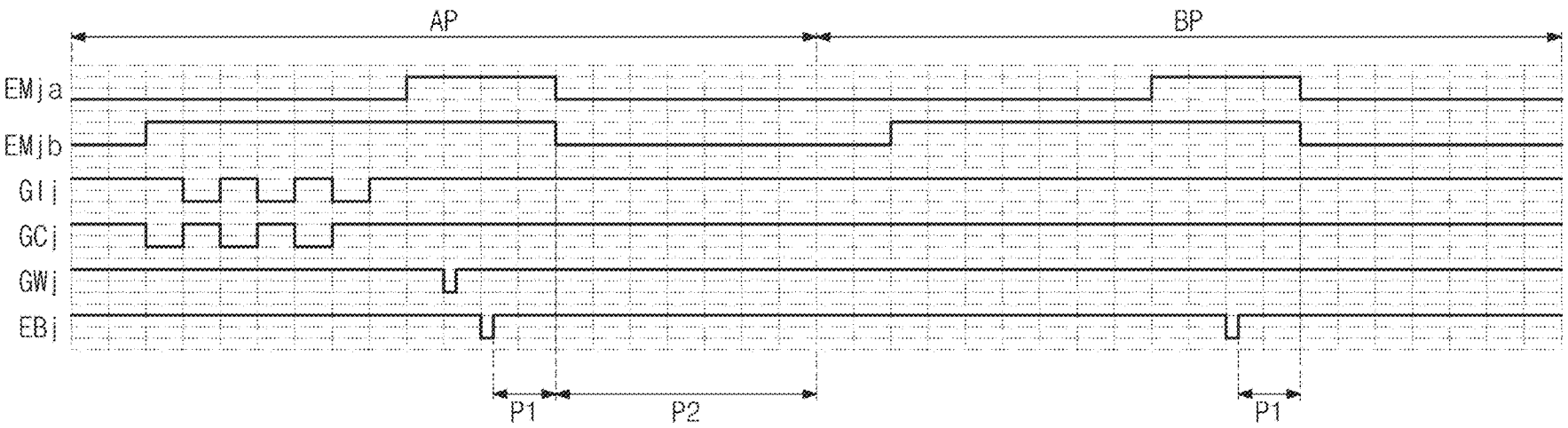
FIGS. 10A and 10B are timing diagrams describing an operation of an active section and a blank section of a pixel illustrated in FIG. 2.
Figure 10B:
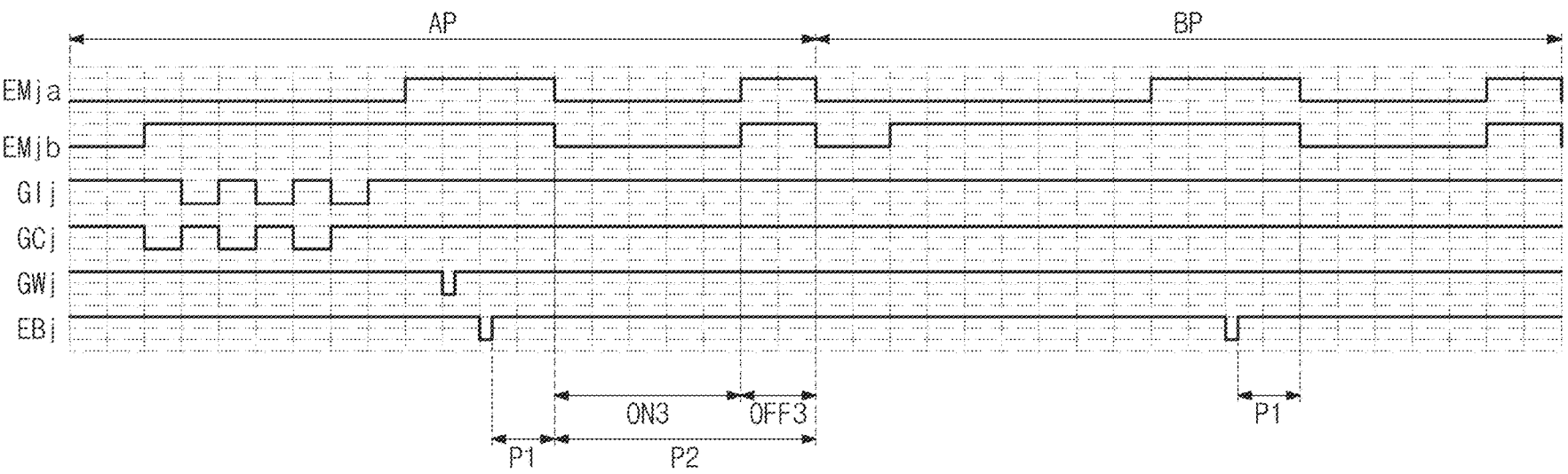

FIGS. 10A and 10B are timing diagrams describing an operation of the active section AP and the blank section BP of a pixel illustrated in FIG. 2.

FIG. 10A illustrates the active section AP and the blank section BP of the pixel PXij illustrated in FIG. 2 when the light emission ratio AOR is about 5%. FIG. 10B illustrates the active section AP and the blank section BP of the pixel PXij illustrated in FIG. 2 when the light emission ratio AOR is about 80%.

Referring to FIGS. 2 and 10A, when the light emission ratio AOR is about 5%, the light emission control signal EMja and the light emission control signal EMjb transition to an active level (e.g., a low level) when the first section P1 elapses after the scan signal EBj transitions to an inactive level (e.g., a high level) from an active level (e.g., a low level). Therefore, the light-emitting diode ED in the pixel PXij may emit light during the second section P2.

Referring to FIGS. 2 and 10B, when the light emission ratio AOR is about 80%, the light emission control signal EMja and the light emission control signal EMjb transition to an active level (e.g., a low level) when the first section P1 elapses after the scan signal EBj transitions to an inactive level (e.g., a high level) from an active level (e.g., a low level). The light-emitting diode ED in the pixel PXij emits light during a light-emission-on section ON3 of the second section P2 and does not emit light during a light-emission-off section OFF3.

Referring to FIGS. 10A and 10B, the light emission time of the light-emitting diode ED may be adjusted depending on the light emission ratio AOR during the active section AP so that the emission luminance of the pixel PXij may be adjusted.

In the blank section BP, regardless of the light emission ratio AOR, when the first section P1 elapses after the scan signal EBj transitions from the active level (e.g., the low level) to the inactive level (e.g., the high level), the light emission control signal EMjb and the light emission control signal EMjb transition to the active level.

Therefore, even when the light emission ratio AOR of the display device DD is changed, the luminance change depending on the hysteresis characteristic of the first transistor T1 in the blank section BP may be minimized.

In an embodiment of the invention, a display device may adjust the luminance of a pixel by adjusting a pulse width of the light emission control signal. In particular, by adjusting the light-emission-on section and the light-emission-off section of the light emission control signal depending on the light emission ratio, it is possible to minimize deterioration of image quality due to a hysteresis characteristic of a first transistor.

While the invention has been described with reference to embodiments thereof, it will be apparent to those of ordinary skill in the art that various changes and modifications may be made thereto without departing from the spirit and scope of the invention as set forth in the following claims.

What is claimed is:

1. A pixel comprising:

a light-emitting diode; and a pixel circuit which provides a current corresponding to a data signal to the light-emitting diode in response to a plurality of scan signals and a light emission control signal, the light emission control signal including:

a first section; and a second section including:

a light-emission-on section; and a light-emission-off section subsequent to the light-emission-on section, wherein the light emission control signal has an active level in the light-emission-on section, and has an inactive level in each of the first section and the light-emission-off section, wherein the light-emission-on section and the light-emission-off section of the light emission control signal vary depending on a light emission ratio of a dimming mode, and wherein a maintaining time of the first section of the light emission control signal is uniformly maintained when the light emission ratio is changed.

2. The pixel of claim 1, wherein as the light emission ratio of the dimming mode increases, the light-emission-on section of the second section decreases and the light-emission-off section of the second section increases.

3. The pixel of claim 1, wherein the first section is a time section until the light emission control signal transitions from the inactive level to the active level, after any one of the plurality of scan signals transitions from the active level to the inactive level.

4. The pixel of claim 1, wherein the light-emitting diode includes a first electrode, and the pixel circuit includes:

a first capacitor connected between a first node and a second node;

a first transistor including a first electrode electrically connected to a first voltage line, a second electrode electrically connected to the first electrode of the light-emitting diode, and a gate electrode connected to the second node;

a second transistor including a first electrode which receives the data signal, a second electrode connected to the first node, and a gate electrode which receives a first scan signal among the plurality of scan signals; and a third transistor including a first electrode connected to the second electrode of the first transistor, a second electrode connected to the second node, and a gate electrode which receives a second scan signal among the plurality of scan signals.

5. The pixel of claim 4, wherein the light emission control signal includes a first light emission control signal and a second light emission control signal.

6. The pixel of claim 5, wherein the pixel circuit includes:

a light emission control transistor including a first electrode connected to the first voltage line, a second electrode connected to the first electrode of the first transistor, and a gate electrode which receives the first light emission control signal; and a bias transistor including a first electrode connected to the first electrode of the first transistor, a second electrode which receives a bias voltage, and a gate electrode which receives a fourth scan signal among the plurality of scan signals.

7. The pixel of claim 6, wherein the light-emitting diode further includes a second electrode, and the first voltage line receives a first driving voltage, and wherein the second electrode of the light-emitting diode is connected to a second voltage line which receives a second driving voltage different from the first driving voltage.

8. The pixel of claim 6, wherein the pixel circuit further includes:

a fourth transistor including a first electrode connected to the first node, a second electrode connected to a third voltage line, and a gate electrode which receives the second scan signal;

a fifth transistor including a first electrode connected to the second node, a second electrode connected to a fourth voltage line, and a gate electrode which receives a third scan signal among the plurality of scan signals;

a sixth transistor including a first electrode connected to the second electrode of the first transistor, a second electrode connected to the first electrode of the light-emitting diode, and a gate electrode which receives the second light emission control signal;

a seventh transistor including a first electrode connected to the first electrode of the light-emitting diode, a second electrode connected to the fourth voltage line, and a gate electrode which receives the fourth scan signal among the plurality of scan signals; and a second capacitor connected between the first voltage line and the first node.

9. The pixel of claim 8, wherein the third voltage line receives a reference voltage, and the fourth voltage line receives an initialization voltage.

10. The pixel of claim 8, wherein each of the first light emission control signal and the second light emission control signal includes the first section and the second section, and wherein the second section includes the light-emission-on section and the light-emission-off section.

11. The pixel of claim 1, wherein one frame includes an active section and a blank section, wherein the pixel circuit receives the data signal during the active section, wherein the pixel circuit does not receive the data signal during the blank section, and wherein each of the active section and the blank section includes the first section and the second section.

12. A display device comprising:

a plurality of scan lines;

a light emission control line;

a data line;

a display panel including a pixel connected to the plurality of scan lines, the light emission control line, and the data line, the pixel including:

a light-emitting diode; and a pixel circuit;

a scan driving circuit which outputs a plurality of scan signals to the plurality of scan lines;

a data driving circuit which outputs a data signal to the data line;

a light emission driving circuit which outputs a light emission control signal to the light emission control line; and a driving controller which controls the scan driving circuit, the data driving circuit, and the light emission driving circuit, wherein the pixel circuit provides a current corresponding to the data signal to the light-emitting diode in response to the plurality of scan signals and the light emission control signal, wherein the light emission control signal includes a first section and a second section, wherein the second section includes a light-emission-on section and a light-emission-off section, wherein the light emission control signal has an active level in the light-emission-on section, and has an inactive level in each of the first section and the light-emission-off section, and wherein the light-emission-on section and the light-emission-off section of the light emission control signal vary depending on a light emission ratio of a dimming mode, and wherein a maintaining time of the first section of the light emission control signal is uniformly maintained when the light emission ratio is changed.

13. The display device of claim 12, wherein as the light emission ratio of the dimming mode increases, the light-emission-on section of the second section decreases and the light-emission-off section of the second section increases.

14. The display device of claim 12, wherein the first section is a time section until the light emission control signal transitions from the inactive level to the active level, after any one of the plurality of scan signals transitions from the active level to the inactive level.

15. The display device of claim 12, wherein the light-emitting diode includes a first electrode, and the pixel circuit includes:

a first capacitor connected between a first node and a second node;

a first transistor including a first electrode electrically connected to a first voltage line, a second electrode electrically connected to the first electrode of the light-emitting diode, and a gate electrode connected to the second node;

a second transistor including a first electrode connected to the data line, a second electrode connected to the first node, and a gate electrode which receives a first scan signal among the plurality of scan signals; and a third transistor including a first electrode connected to the second electrode of the first transistor, a second electrode connected to the second node, and a gate electrode which receives a second scan signal among the plurality of scan signals.

16. The display device of claim 15, wherein the pixel circuit includes:

a fourth transistor including a first electrode connected to the first node, a second electrode connected to a third voltage line, and a gate electrode which receives the second scan signal;

a fifth transistor including a first electrode connected to the second node, a second electrode connected to a fourth voltage line, and a gate electrode which receives a third scan signal among the plurality of scan signals;

a sixth transistor including a first electrode connected to the second electrode of the first transistor, a second electrode connected to the first electrode of the light-emitting diode, and a gate electrode which receives a second light emission control signal;

a seventh transistor including a first electrode connected to the first electrode of the light-emitting diode, a second electrode connected to the fourth voltage line, and a gate electrode which receives a fourth scan signal among the plurality of scan signals;

an eighth transistor including a first electrode connected to the first electrode of the first transistor, a second electrode which receives a bias voltage, and a gate electrode which receives the fourth scan signal among the plurality of scan signals;

a ninth transistor including a first electrode connected to the first voltage line, a second electrode connected to the first electrode of the first transistor, and a gate electrode which receives a first light emission control signal; and a second capacitor connected between the first voltage line and the first node, and wherein the light emission control signal includes the first light emission control signal and the second light emission control signal.

17. A display device comprising:

a light-emitting diode including a first electrode;

a first capacitor directly connected between a first node and a second node;

a first transistor including a first electrode electrically connected to a first voltage line, a second electrode electrically connected to the first electrode of the light-emitting diode, and a gate electrode connected to the second node;

a second transistor including a first electrode connected to a data line, a second electrode connected to the first node, and a gate electrode which receives a first scan signal; and a third transistor including a first electrode connected to the second electrode of the first transistor, a second electrode connected to the second node, and a gate electrode which receives a second scan signal;

a light emission control transistor including a first electrode connected to the first voltage line, a second electrode connected to the first electrode of the first transistor, and a gate electrode which receives a first light emission control signal; and a bias transistor including a first electrode connected to the first electrode of the first transistor, a second electrode which receives a bias voltage, and a gate electrode which receives a third scan signal, and wherein the first light emission control signal includes a first section and a second section, wherein the second section includes a light-emission-on section and a light-emission-off section, wherein the first light emission control signal has an active level in the light-emission-on section, and has an inactive level in each of the first section and the light-emission-off section, and wherein the light-emission-on section and the light-emission-off section of the first light emission control signal vary depending on a light emission ratio of a dimming mode.

18. The display device of claim 17, further comprising:

a fourth transistor including a first electrode connected to the first node, a second electrode connected to a reference voltage line, and a gate electrode which receives the second scan signal;

a fifth transistor including a first electrode connected to the second node, a second electrode connected to an initialization voltage line, and a gate electrode which receives a fourth scan signal;

a sixth transistor including a first electrode connected to the second electrode of the first transistor, a second electrode connected to the first electrode of the light-emitting diode, and a gate electrode which receives a second light emission control signal; and a seventh transistor including a first electrode connected to the first electrode of the light-emitting diode, a second electrode connected to the initialization voltage line, and a gate electrode which receives the third scan signal.

* * * * *